US008059842B2

(12) United States Patent
Suzuki et al.

(10) Patent No.: US 8,059,842 B2
(45) Date of Patent: Nov. 15, 2011

(54) CAPACITOR MICROPHONE

(75) Inventors: Yukitoshi Suzuki, Hamamatsu (JP); Tamito Suzuki, Fukuroi (JP)

(73) Assignee: Yamaha Corporation, Hamamatsu-Shi (JP)

( * ) Notice: Subject to any disclaimer, the term of this patent is extended or adjusted under 35 U.S.C. 154(b) by 1378 days.

(21) Appl. No.: 11/470,991

(22) Filed: Sep. 7, 2006

(65) Prior Publication Data

US 2007/0058825 A1 Mar. 15, 2007

(30) Foreign Application Priority Data

| | | |
|---|---|---|
| Sep. 9, 2005 | (JP) | P2005-261804 |
| Jun. 16, 2006 | (JP) | P2006-167308 |
| Jul. 7, 2006 | (JP) | P2006-188459 |
| Aug. 18, 2006 | (JP) | P2006-223425 |

(51) Int. Cl.
*H04R 25/00* (2006.01)

(52) U.S. Cl. ..... 381/174; 381/369; 381/175; 381/173

(58) Field of Classification Search ..... 381/174, 381/369, 178, 179, 175
See application file for complete search history.

(56) References Cited

U.S. PATENT DOCUMENTS

| | | | | |
|---|---|---|---|---|
| 7,466,834 | B2 * | 12/2008 | Ogura et al. | 381/174 |
| 7,466,864 | B2 * | 12/2008 | Nakaya | 382/232 |

FOREIGN PATENT DOCUMENTS

| | | | |
|---|---|---|---|
| JP | 58-24300 | | 2/1983 |
| JP | 7-284199 | | 10/1995 |
| JP | 08-084396 | | 3/1996 |
| JP | 8-240609 | | 9/1996 |
| JP | 2004-506394 | | 2/2004 |
| TW | 518900 | B | 1/2003 |
| WO | WO 02/052893 | A1 | 7/2002 |
| WO | WO 2005/111555 | A1 | 11/2005 |

OTHER PUBLICATIONS

Toshifumi Tajima, et al., "Mechanical properties of capacitive silicon microphone," NHK Science and Technical Research Laboratories (Nov. 2001), pp. 95-98.

* cited by examiner

*Primary Examiner* — Davetta Goins
*Assistant Examiner* — Jasmine Pritchard
(74) *Attorney, Agent, or Firm* — Dickstein Shapiro LLP

(57) ABSTRACT

A capacitor microphone is constituted by a plate having a fixed electrode, a diaphragm including a center portion and at least one near-end portion that is fixed to the outer periphery, in which the center portion having a vibrating electrode, which is positioned relative to the fixed electrode and which vibrates in response to sound waves, is increased in rigidity in comparison with the near-end portion; and a spacer that is fixed to the plate and the near-end portion of the diaphragm and that has an air gap formed between the plate and the diaphragm. Alternatively, a diaphragm electrode is horizontally supported by extension arms extended from a circular plate thereof and is vertically held in a hanging state being apart from a fixed electrode with a controlled distance therebetween.

16 Claims, 26 Drawing Sheets

CAPACITOR MICROPHONE

TECHNICAL FIELD

The present invention relates to capacitor microphones and in particular to capacitor microphones using semiconductor diaphragms.

The present application claims priority on four Japanese patent applications, i.e., Patent Application No. 2005-261804 (filing date: Sep. 9, 2005), Patent Application No. 2006-167308 (filing date: Jun. 16, 2006), Patent Application No. 2006-188459 (filing date: Jul. 7, 2006), and Patent Application No. 2006-223425 (filing date: Aug. 18, 2006), the contents of which are incorporated herein by reference.

BACKGROUND ART

Conventionally, it is known that capacitor microphones can be manufactured in accordance with manufacturing processes used for semiconductor devices. Capacitor microphones are designed such that electrodes are attached to plates and diaphragms vibrating due to sound waves, wherein the plates and diaphragms are supported and distanced from each other by way of insulating spacers. Capacitor microphones convert capacitance variations due to displacements of diaphragms, included in capacitors constituted by plates and diaphragms, into electric signals. Sensitivities of capacitor microphones can be improved by increasing ratios of displacements of diaphragms in comparison with distances between electrodes, thus reducing leak currents of spacers and parasitic capacitances.

The document entitled MSS-01-34 published by the Institute of Electrical Engineers in Japan teaches a capacitor microphone in which both of a plate and a diaphragm vibrating due to sound waves are formed using conductive thin films. Due to the uniform rigidity of the diaphragm, even when the diaphragm propagates sound waves, only the center portion of the diaphragm vibrates with a maximum displacement, and the displacement due to the vibration of the diaphragm becomes small in a direction from the center portion to the outer periphery fixed to the spacer. That is, the other portions other than the center portion of the diaphragm having the uniform rigidity may reduce the sensitivity of the capacitor microphone. It may be possible to increase the sensitivity of the capacitor microphone by increasing the ratio of the maximum displacement of the diaphragm in comparison with the distance between the plate and the diaphragm. In this case, a bias occurs when the diaphragm approaches the plate so as to cause electrostatic absorption, by which the plate absorbs the diaphragm; in other words, there is a problem regarding the occurrence of a pull-in event.

Japanese Patent Application Publication No. 2004-506394 (corresponding to WO2002/015636) teaches an example of a capacitor microphone (serving as an acoustic transducer) using a semiconductor substrate such as a silicon substrate. Herein, the outer periphery of a fixed electrode having a plate-like shape is fixed to an insulating layer formed on the semiconductor substrate so that the fixed electrode is supported by and bridged over the insulating layer, wherein a diaphragm electrode is supported in parallel with the fixed electrode with a relative distance therebetween, so that variations of the relative distance that occur when the diaphragm electrode vibrates due to sound waves are detected as variations of electrostatic capacitance.

In the aforementioned capacitor microphone, it is preferable that the fixed electrode be held in a fixed state with the insulating layer, and the diaphragm electrode be easily vibrated due to sound waves. Specifically, supports are extended inwardly from the insulating layer and are used to hang the diaphragm electrode at inner ends thereof so as to separate the diaphragm electrode from the insulating layer, thus realizing free deformation with respect to the diaphragm electrode.

In the manufacturing process of the capacitor microphone, tensile stress may remain in the diaphragm electrode, which is formed using a conductive film at a high temperature. Due to the tensile stress, the diaphragm electrode may be slightly bent or deformed, thus reducing the air gap between the diaphragm electrode and the fixed electrode. When these electrodes approach each other so as to be very close, these electrodes may come in contact with each other due to electrostatic attraction exerted therebetween, thus reducing a pull-in potential. In order to avoid the occurrence of a pull-in event, it is necessary to reduce the bias voltage applied to the capacitor microphone. Due to such a restriction, the manufacturer experiences difficulty in manufacturing high-sensitivity capacitor microphones.

Even though the diaphragm electrode is supported in a hanging state and is separated from the insulating layer, a terminal for applying voltage from an external device is extended from a part of the outer circumferential portion of the diaphragm electrode and is fixed to the insulating layer, whereby the diaphragm electrode is supported in an unbalanced manner such that it is hung downwardly by means of the support and it is also supported horizontally by way of the terminal fixed to the insulating layer. This makes the air gap (formed between the diaphragm electrode and the fixed electrode) become easily non-uniform, whereby the air gap may be reduced partially so as to cause a reduction of a pull-in potential. Such a problem causes another limitation in increasing the bias voltage applied to the capacitor microphone.

Furthermore, the non-uniform air gap and the fixation of the terminal interfere with vibration of the diaphragm electrode, which may cause asymmetrical deformation with respect to the center of the diaphragm. This produces dispersions of sensitivities and makes it difficult to predict the performance in designing.

DISCLOSURE OF INVENTION

It is an object of the present invention to provide a capacitor microphone whose sensitivity can be improved without causing the occurrence of a pull-in event.

It is another object of the present invention to provide a capacitor microphone in which a certain air gap is reliably held between a diaphragm electrode and a fixed electrode so as to increase the sensitivity in acoustic-electric conversion.

It is a further object of the present invention to provide a capacitor microphone in which uniform distribution of stress is secured with respect to a diaphragm electrode so as to simplify designing and to improve sensitivity.

In a first aspect of the present invention, a capacitor microphone includes a plate having a fixed electrode, a diaphragm including a center portion and at least one near-end portion that is fixed to the outer periphery, in which the center portion having a vibrating electrode, which is positioned relative to the fixed electrode and which vibrates in response to sound waves, is increased in rigidity in comparison with the near-end portion, and a spacer that is fixed to the plate and the near-end portion of the diaphragm and that has an air gap formed between the plate and the diaphragm.

In the diaphragm, the center portion is increased in rigidity in comparison with the near-end portion; hence, it is possible to reduce the amount of deformation occurring in the center portion in response to sound pressure in comparison with the conventionally-known diaphragm having uniform rigidity. In other words, due to the relatively small deviation of displacement at the center portion of the diaphragm, it is possible to increase the variable capacitance of the mike capacitor (which varies in response to sound waves) without increasing the maximum displacement applied to the diaphragm. Thus, it is possible to increase the sensitivity of the capacitor microphone without causing a pull-in event.

In the above, the center portion of the diaphragm is increased in thickness in comparison with the near-end portion. This increases the rigidity at the center portion of the diaphragm compared with the near-end portion. In addition, the near-end portion of the diaphragm is formed using a first film (e.g., a conductive film 110), and the center portion of the diaphragm is formed using the first film and a second film (e.g., a conductive film 108) which is increased in hardness in comparison with the first film. This also increases the rigidity at the center portion of the diaphragm compared with the near-end portion. Alternatively, the second film can be decreased in density in comparison with the first film. This increases the rigidity at the center portion of the diaphragm and also reduces the weight of the center portion of the diaphragm. Due to the reduced weight of the center portion of the diaphragm, it is possible to improve the sensitivity of the capacitor microphone in response to high-frequency sound. Furthermore, the rigidity of the diaphragm can be gradually increased in the direction from the outer periphery to the center portion. This allows the diaphragm to vibrate in response to sound waves while smoothly being deformed. Due to the smooth deformation, stress caused by the deformation can be uniformly distributed over the entire surface of the diaphragm; hence, it is possible to reduce the thickness of the diaphragm and to reduce the overall rigidity of the diaphragm, so that the diaphragm can be vibrated with a relatively large amplitude. Due to the reduced thickness of the diaphragm, it is possible to improve the sensitivity of the capacitor microphone in response to high-frequency sound.

The diaphragm can be formed using a thin portion and a thick portion whose density is gradually increased in the direction from the outer periphery to the center portion, whereby the rigidity of the diaphragm is gradually increased in the direction from the outer periphery to the center portion. Herein, the thin portion is formed using the first film, and the thick portion is formed using the first film and the second film which is increased in hardness in comparison with the first film. Alternatively, the thin portion is formed using the first film, and the thick portion is formed using the first film and the second film which is decreased in density in comparison with the first film. Thus, it is possible to increase the rigidity of the thick portion of the diaphragm while reducing the weight of the thick portion. Due to the reduced weight of the thick portion of the diaphragm, it is possible to increase the resonance frequency of the lowest order with respect to the capacitor microphone; thus, it is possible to improve the sensitivity of the capacitor microphone in response to high-frequency sound.

In a second aspect of the present invention, a capacitor microphone is designed using a diaphragm electrode that is distanced and supported in parallel with a fixed electrode, which is bridged over an internal space of an insulating layer formed in a surrounding area of a hollow of a semiconductor substrate, thus detecting variations of electrostatic capacitance formed between the fixed electrode and the diaphragm electrode in response to variations of sound pressure applied to the diaphragm electrode. The capacitor microphone includes a circular plate that is incorporated into the diaphragm electrode and is supported by inner ends of supports extended inwardly from the insulating layer in a hanging state in parallel with the fixed electrode, and a plurality of extension arms that project outwardly from the outer periphery of the circular plate and that are arranged with equal spacing therebetween in the circumferential direction of the circular plate, wherein the tip ends of the extension arms are fixed to the insulating layer, and wherein the tip end of one extension arm is connected with an external connection terminal, which is exposed from the insulating layer.

That is, the circular plate of the diaphragm electrode is supported vertically in a hanging state by means of the supports and is also supported horizontally by means of the extension arms, wherein the extension arms are arranged with equal spacing therebetween in the circumferential direction of the circular plate; hence, tensile stress occurs in the manufacturing process and is uniformly distributed to the circular plate in a radial direction, thus uniformly maintaining the gap between the diaphragm electrode and the fixed electrode. When the circular plate vibrates, the extension arms produce resistance, which is uniformly and horizontally applied to the circular plate; hence, it is possible to prevent the circular plate from being deformed in an asynchronous manner.

In the above, each of the extension arms has a stress-adjusting portion for adjusting tensile stress exerted on the circular plate outwardly in a radius direction. That is, it is preferable that the tensile stress applied to the circular plate be adjusted so as to prevent the circular plate from approaching very close to the fixed electrode. The stress-adjusting portions are each reduced in residual stress by doping impurities into prescribed portions of the diaphragm electrode composed of polycrystal silicon. Alternatively a plurality of through holes are formed in prescribed portions of the diaphragm electrode so as to partially reduce sectional areas.

As described above, it is possible to prevent the circular plate from approaching very close to the fixed electrode; hence, it is possible to uniformly maintain the gap between the diaphragm electrode and the fixed electrode. In addition, it is possible to prevent the circular plate from approaching very close to the fixed electrode; hence, it is possible to uniformly maintain the gap between these electrodes. Furthermore, it is possible to avoid non-uniform variations of the gap between these electrodes; hence, it is possible to increase pull-in voltage so as to improve the sensitivity of the capacitor microphone.

In a third aspect of the invention, a capacitor microphone is designed such that a fixed electrode is bridged over an internal space of an insulating layer formed to surround the outer periphery of a hollow of a semiconductor substrate, and a diaphragm electrode is supported in parallel with the fixed electrode with a prescribed distance therebetween, so that variations of electrostatic capacitance between the fixed electrode and the diaphragm electrode are detected in response to variations of pressure applied to the diaphragm electrode. The diaphragm electrode has a circular plate that is supported in a hanging state in parallel with the fixed electrode by way of inner terminals of supports inwardly extending from the insulating layer; one end of an extension terminal is fixed to a prescribed portion of the insulating layer in the outer periphery of the circular plate; and another end of the extension terminal is outwardly exposed from the insulating layer. In addition, a stress absorbing portion that is easily deformable in comparison with the circular plate is formed at a prescribed position of the extension terminal between the circular plate and the prescribed portion of the insulating layer.

That is, the circular plate of the diaphragm electrode is vertically supported by the supports in a hanging state and is also horizontally supported by the extension terminal. The stress absorbing portion of the extension terminal reliably absorbs tensile stress that occurs after the manufacturing process; hence, it is possible to secure uniform distribution of stress applied to the circular plate; and it is possible to secure the uniform gap between the fixed electrode and the diaphragm electrode. When the circular plate vibrates, the extension terminal correspondingly vibrates, wherein the extension terminal does not affect vibration of the circular plate because the stress absorbing portion has a relatively small resistance against deformation.

In the above, a plurality of extension arms are formed and are extended outwardly in the radius direction in the outer periphery of the circular plate and are positioned with the prescribed spacing therebetween in the circumferential direction. Herein, each of the extension arms has a prescribed portion fixed to the insulating layer so that a stress absorbing portion, which is easily deformable in comparison with the circular plate, is formed between the circular plate and the prescribed portion of the insulating layer. Thus, in comparison with a capacitor microphone in which the circular plate of the diaphragm electrode is horizontally supported at one position by means of the extension terminal, the present invention can support the circular plate in a distributed manner by means of the extension arms; hence, it is possible to realize uniform distribution of stress applied to the circular plate.

When the extension terminal and the extension arms are positioned with equal spacing therebetween in the outer periphery of the circular plate of the diaphragm electrode, it is possible to further improve the uniform distribution of stress applied to the circular plate.

In addition, the stress absorbing portion is formed in a bent shape or a curved shape so that the overall length thereof is larger than a distance between the circular plate and the insulating layer in the radius direction. This makes it possible for the stress absorbing portion to be stretched, contracted, or deformed, thus absorbing stress. The stress absorbing portion can be formed in a meandering shape (i.e., a horizontally bent shape) or a waved shape (i.e., a vertically bent shape in the thickness direction). Alternatively, the stress absorbing portion can be curved in a catenary shape.

Alternatively, a plurality of through holes can be formed in the stress absorbing portion, thus realizing free expansion or contraction. The through holes can be formed in prescribed shapes such as circular shapes, triangular shapes, rectangular shapes, and hexagonal shapes. They can be arranged in a zigzag manner.

As described above, the capacitor microphone realizes uniform distribution of stress applied to the circular plate of the diaphragm electrode because the stress absorbing portion of the extension terminal reliably absorbs the stress applied to the circular plate, thus realizing the uniform distribution of the stress applied to the circular plate. This produces the uniform gap between the fixed electrode and diaphragm electrode, thus improving the freedom of degree in designing. In addition, it is possible to improve the response because the circular plate smoothly vibrates without disturbances. This increases the bias voltage applied to the capacitor microphone, thus improving the sensitivity.

BEST MODE FOR CARRYING OUT THE INVENTION

The present invention will be described in detail by way of examples with reference to the accompanying drawings.

1. First Embodiment

Figure 2:
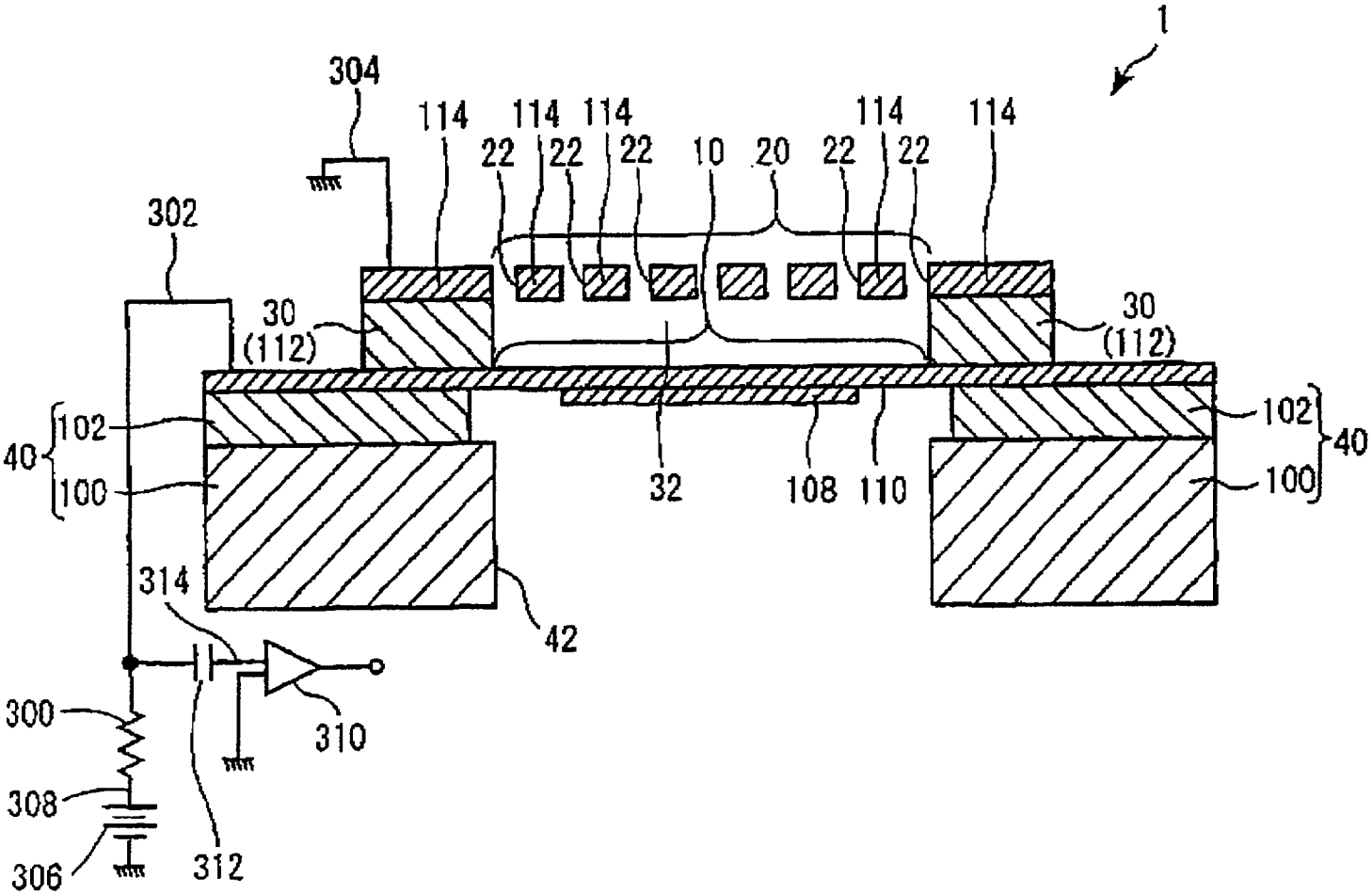
FIG. 2 is a cross-sectional view showing the constitution of the capacitor microphone in accordance with the first embodiment of the present invention.
Figure 3A:
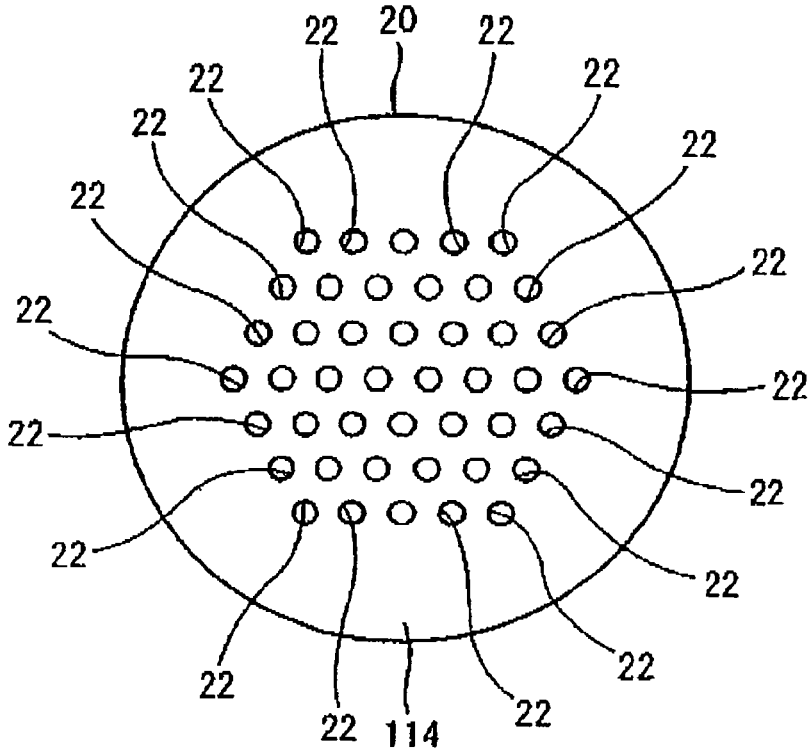
FIG. 3A is a plan view showing a back plate incorporated into the capacitor microphone shown in FIG. 2.
Figure 3B:
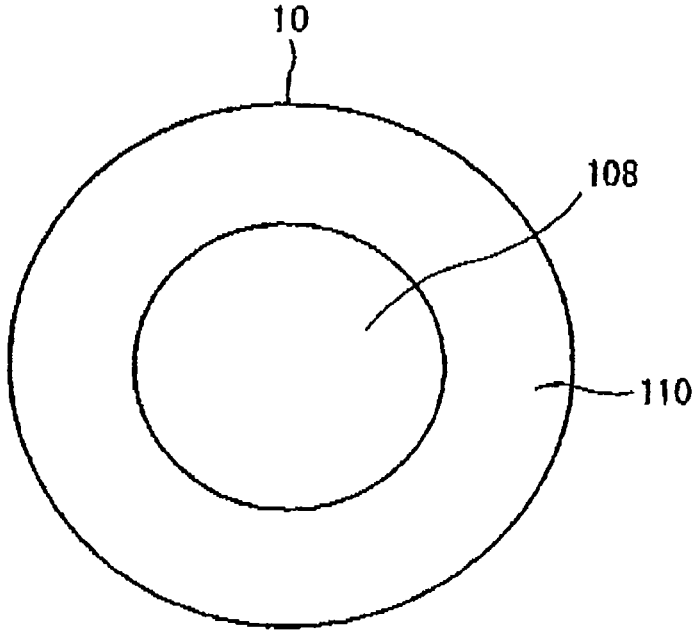
FIG. 3B is a plan view showing a diaphragm incorporated into the capacitor microphone shown in FIG. 2.

The overall constitution of a capacitor microphone according to a first embodiment of the present invention will be described with reference to FIG. 2 and FIGS. 3A and 3B. FIG. 2 is a cross-sectional view diagrammatically showing the constitution of a capacitor microphone 1; FIG. 3A is an upper view of a back plate 20 included in the capacitor microphone 1; and FIG. 3B is a lower view of a diaphragm 10 included in the capacitor microphone 1.

The capacitor microphone 1 is called a "silicon microphone" that is produced using semiconductor manufacturing processes. As shown in FIG. 2, the capacitor microphone 1 includes a sound sensing portion and a detection portion realized by electronic circuits.

(a) Constitution of Sound Sensing Portion

As shown in FIG. 2, the sound sensing portion of the capacitor microphone 1 is constituted by the aforementioned diaphragm 10 and the back plate 20 as well as a spacer 30 and a base 40.

The diaphragm 10 includes a prescribed portion (hereinafter, referred to as a non-fixed portion of a conductive film 110), which is not fixed to an insulating film 102 of the conductive film 110 and an insulating film 112, and a conductive film 108 that is fixed to the conductive film 110. The outer periphery of the diaphragm 10 is fixed to the insulating film 102 and the insulating film 112. Both of the conductive film 108 and the conductive film 110 are semiconductor films composed of polycrystal silicon in which impurities are doped, i.e., polysilicon. The conductive film 108 is attached to the center portion of the non-fixed portion of the conductive film 110. That is, the near-end portion close to the outer periphery of the diaphragm 10 is formed using the conductive film 110 only, and the center portion of the diaphragm 10 is formed using the conductive film 110 and the conductive film 108. This increases the center portion of the diaphragm 10 in thickness in comparison with the near-end portion of the diaphragm 10, thus increasing the rigidity of the center portion of the diaphragm 10 to higher than the rigidity of the near-end portion of the diaphragm 10.

Both of the conductive films 108 and 110 can be formed using the same material, or they can be formed using different materials. When the conductive films 108 and 110 are formed using different materials, it is preferable that the hardness of the conductive film 108 be higher than the hardness of the conductive film 110. That is, when the conductive film 108 is formed using the high-hardness material, it is possible to increase the rigidity of the center portion of the diaphragm 10, which is constituted by the conductive films 108 and 110, even though the conductive film 110 is formed using the low-hardness material in order to decrease the rigidity of the near-end portion of the diaphragm 10. For example, when the conductive film 110 is formed using polysilicon, it is possible to use prescribed compounds such as SiCx, SiGe, and SiGeC as well as other compounds in which impurities are doped into the prescribed compounds so as to adjust specific resistances with respect to the conductive film 108.

It is preferable that the conductive film 108 be formed using the low-density material in comparison with the conductive film 110. When the conductive film 108 is formed using the low-density material, it is possible to reduce the weight of the center portion of the diaphragm 10 constituted by the conductive films 108 and 110. Due to the reduced weight of the center portion of the diaphragm 10, it is possible to noticeably improve the sensitivity of the capacitor microphone 1 in response to high-frequency sound.

As shown in FIG. 2, the center portion of the diaphragm 10 projects in the side of the base 40. Alternatively, it can project in the side of the back plate 20. Of course, it can project in both sides. The entire portion of the diaphragm 10 is not necessarily formed using conductive films; that is, the diaphragm 10 can be formed using an insulating film whose thickness is increased in the center portion compared with the near-end portion and an electrode, for example. In addition, the conductive film 108 can be replaced with an insulating film; and the conductive film 110 can be replaced with an insulating film. When the insulating film is substituted for the conductive film 110, the exterior shape of the conductive film 108 is designed such that it is connected to a connection pad of the detection portion. The diaphragm 10 can be formed in a disk-like shape as shown in FIG. 3B; or it can be formed in other shapes.

As shown in FIG. 2, the back plate 20 (serving as the "plate") is formed using a non-fixed portion that is not fixed to the insulating film 112 of a conductive film 114. The conductive film 114 is a semiconductor film composed of polysilicon, for example. A plurality of through holes 22 are formed in the back plate 20. They allow sound waves from a sound source (not shown) to transmit through the back plate 20. As a result, sound waves from the sound source are transmitted through the diaphragm 10. Incidentally, the back plate 20 can be formed in a disk-like shape as shown in FIG. 3A; or it can be formed in other shapes. In addition, the through holes 22 can be formed in circular shapes as shown in FIG. 3A; or they can be formed in other shapes.

As shown in FIG. 2, the spacer 30 is formed using the insulating film 112, which is an oxidation film composed of $SiO_2$, for example. The spacer 30 supports the diaphragm 10 and the back plate 20 to be insulated from each other, wherein an air gap 32 is formed between the diaphragm 10 and the back plate 20.

The base 40 is constituted by the insulating film 102 and a substrate 100. The substrate 100 is a monocrystal silicon substrate. The insulating film 102 is an oxidation film composed of $SiO_2$, for example. A through hole 42 serving as a back cavity is formed in the base 40.

The capacitor microphone 1 can be modified such that the diaphragm 10 is positioned close to the sound source in comparison with the back plate 20, thus making sound waves directly transmit through the diaphragm 10. In this case, the through holes 22 of the back plate 20 function as channels for establishing communications between the air gap 32 (which is formed between the diaphragm 10 and the back plate 20) and the through hole (or recess) 42 of the base 40 serving as the back cavity.

(b) Constitution of Detection Portion

The diaphragm 10 is connected to a resistor 300, and the back plate 20 is grounded. Specifically, a lead 302 connected to one end of the resistor 300 is connected to the conductive film 110 of the diaphragm 10, and a lead 304 that is used to ground the substrate of the capacitor microphone 1 is connected to the conductive film 114 forming the back plate 20. A lead 308 connected to an output terminal of a bias power source 306 is connected to the other end of the resistor 300. It is preferable that the resistor 300 have a relatively high resistance of a giga-ohm (GΩ) order. A lead 314 connected to one end of a capacitor 312 is connected to an input terminal of a preamplifier 310. The lead 302 connecting between the diaphragm 10 and the resistor 300 is connected to the other end of the capacitor 312.

(c) Operation of Capacitor Amplifier

When sound waves are transmitted toward the diaphragm 10 via the through holes 22 of the back plate 20, the diaphragm 10 vibrates in relation to the back plate 20. When the diaphragm 10 vibrates, the distance between the diaphragm 10 and the back plate 20 varies, thus changing electrostatic capacitance of a capacitor (or a mike capacitor) constituted by the diaphragm 10 and the back plate 20.

As described above, the diaphragm 10 is connected to the resistor 300 having a relatively high resistance; hence, even when the electrostatic capacitance of the mike capacitor varies in response to the vibration of the diaphragm 10, electric charges accumulated in the mike capacitor will not substantially flow through the resistor 300. In other words, it can be regarded that substantially no variation occurs in electric charged accumulated in the mike capacitor. This makes it possible to detect variations of the electrostatic capacitance of the mike capacitor as variations of the voltage between the diaphragm 10 and the back plate 20.

In the capacitor microphone 1, variations of the voltage of the diaphragm 10 against the ground potential are amplified by the preamplifier 310; hence, it is possible to output electric signals in response to very small variations of the electrostatic capacitance of the mike capacitor. In short, the capacitor microphone 1 is designed such that variations of the sound pressure applied to the diaphragm 10 are converted into variations of the electrostatic capacitance of the mike capacitor, which are then converted into variations of the voltage, thus outputting electric signals having correlation with variations of the sound pressure.

Figure 4:
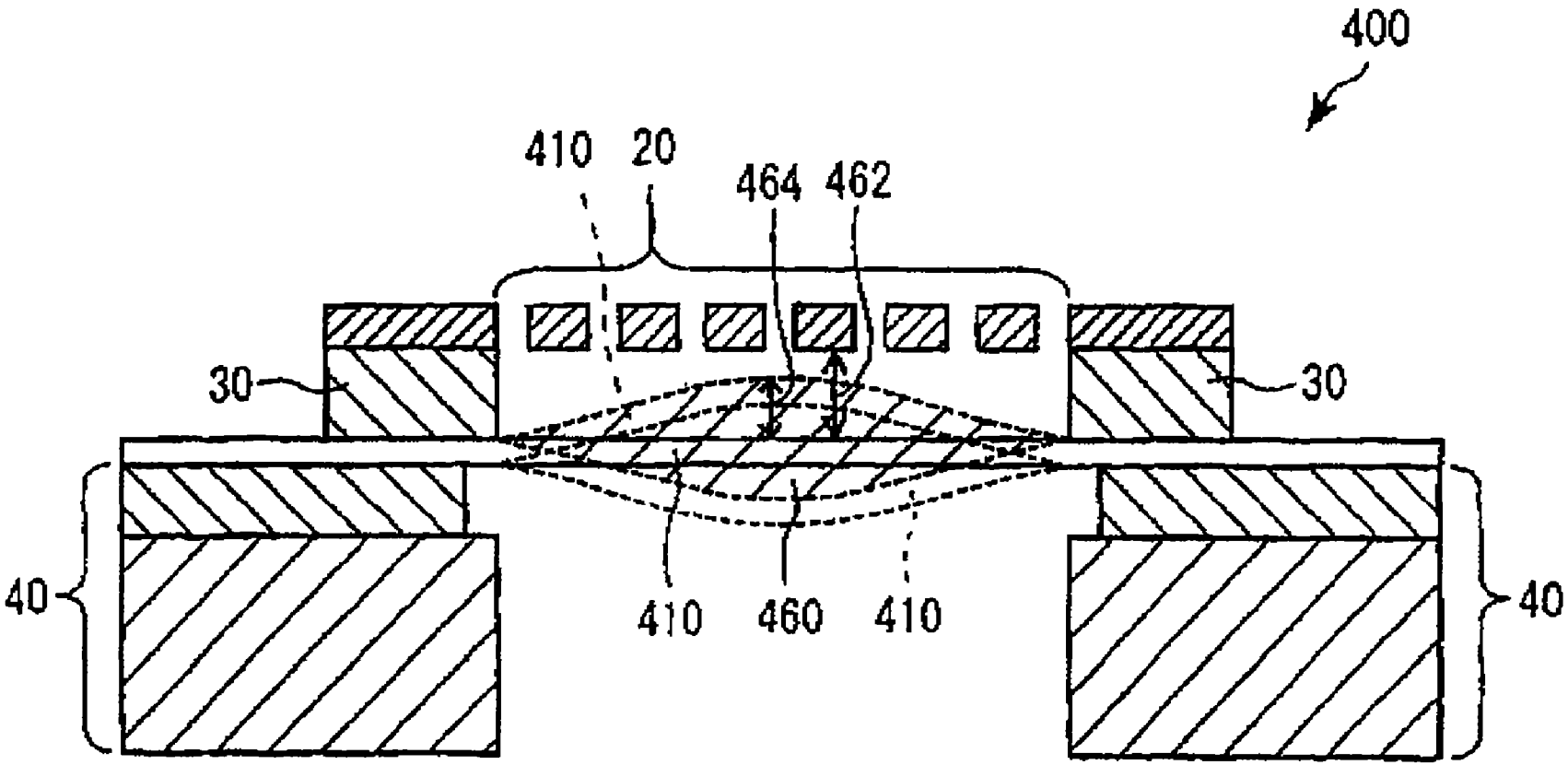
FIG. 4 is a cross-sectional view showing the operation of a conventionally-known capacitor microphone.

In the case of a conventionally-known capacitor microphone 400 having a diaphragm 410 of uniform rigidity as shown in FIG. 4, only the center portion of the diaphragm 410 vibrates with a maximum displacement, so that the displacement due to the vibration of the diaphragm 410 becomes small in a direction from the center portion to the outer periphery fixed to the spacer 30. Hence, as the total displacement applied to the diaphragm 410 (see a hatched area 460 in FIG. 4) becomes small, the sensitivity of the capacitor microphone 400 decreases by way of the other portions other than the center portion of the diaphragm 410. Incidentally, the total displacement of the diaphragm 410 is defined as the sum of displacements occurring in various portions of the diaphragm 410. In order to increase the sensitivity of the capacitor microphone 400, it may be necessary to increase the maximum displacement of the diaphragm 410 (see an arrow 464 in FIG. 4) in connection with the distance between the diaphragm 410 and the back plate 20 (see an arrow 462 in FIG. 4). In this case, there is a problem regarding the occurrence of a pull-in event in which the back plate 20 absorbs the diaphragm 410 by way of electrostatic absorption (or electrostatic attraction) due to a bias that occurs when the diaphragm 410 approaches the back plate 20.

Figure 1:
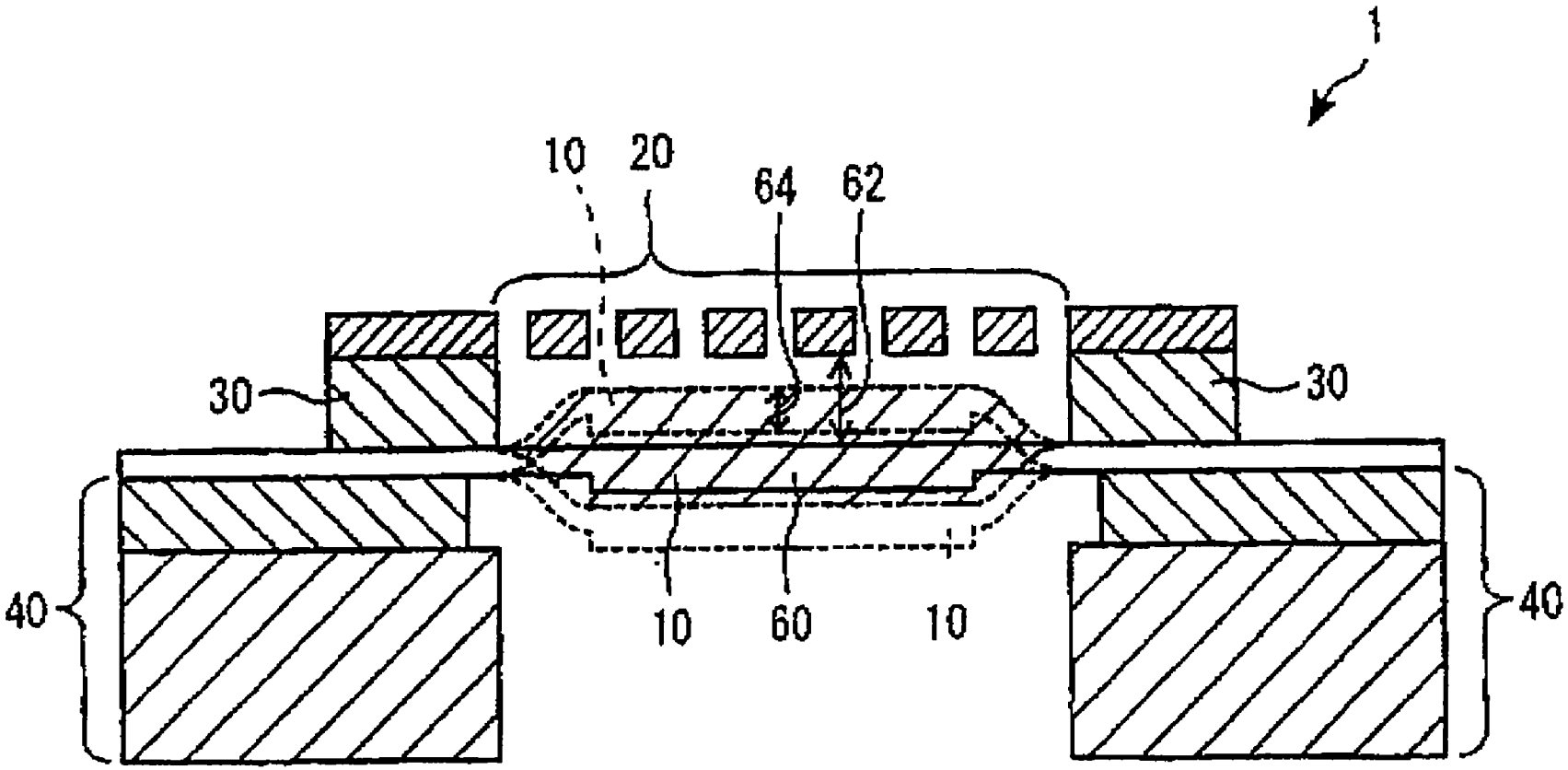
FIG. 1 is a cross-sectional view showing the operation of a capacitor microphone in accordance with a first embodiment of the present invention.

FIG. 1 diagrammatically shows the operation of the capacitor microphone 1 in accordance with the first embodiment of the present invention.

As described above, the hardness of the center portion of the diaphragm 10 is higher than the hardness of the near-end portion of the diaphragm 10. This reduces the displacement of the center portion of the diaphragm 10, which is vibrating, to smaller than the displacement of the conventional diaphragm; hence, the displacement may concentrate at the near-end portion of the diaphragm 10. That is, the deviation of the displacement at the center portion of the diaphragm 10 becomes small, so that the center portion may entirely vibrate with the amplitude substantially matching the maximum amplitude (see an arrow 64 in FIG. 1). By decreasing the deviation of the amplitude at the center portion of the diaphragm 10, it is possible to increase the total displacement of the diaphragm 10 (se a hatched area 60 in FIG. 1) in comparison with the total displacement of the conventionally-known diaphragm (which has the uniform rigidity realizing the same maximum displacement, see a hatched area 460 in FIG. 4). In short, it is possible to increase the variable capacitance of the capacitance microphone 1 (constituted by the diaphragm 10 and the back plate 20) without increasing the maximum displacement of the diaphragm 10. Thus, it is possible to increase the sensitivity of the capacitor microphone 1 while avoiding the occurrence of a pull-in event. Of course, it is possible to increase the maximum displacement of the diaphragm 10 in relation to the distance between the diaphragm 10 and the back plate 20 within a prescribed range that does not cause the occurrence of a pull-in event.

(d) Manufacturing Method

Next, a manufacturing method of the capacitor microphone 1 will be described with reference to FIGS. 5A to 5H and FIGS. 6A to 6H, wherein FIGS. 5A to 5D are cross-sectional views related to plan views shown in FIGS. 5E to 5H (see line A1-A1 in FIG. 5E), and FIGS. 6A to 6D are cross-sectional views related to plan views shown in FIGS. 6E to 6H.

Figure 5A:
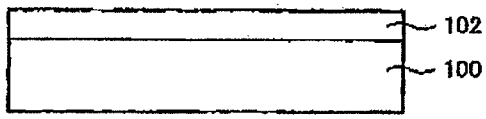
FIG. 5A is a cross-sectional view taken along line A1-A1 in FIG. 5E, which is used to show a first step of manufacturing of the capacitor microphone of the first embodiment.

First, as shown in FIG. 5A, the insulating film 102 is formed on the substrate 100, which is formed using a monocrystal silicon wafer, for example. Specifically, CVD (Chemical Vapor Deposition) is performed on the surface of the substrate 100 so as to realize deposition of $SiO_2$, thus forming the insulating film 102 on the substrate 100. This step can be omitted by using an SOI substrate.

Figure 5B:
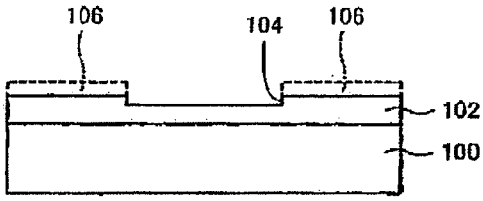
FIG. 5B is a cross-sectional view in correspondence with FIG. 5F, which is used to show a second step of manufacturing of the capacitor microphone of the first embodiment.
Figure 5C:
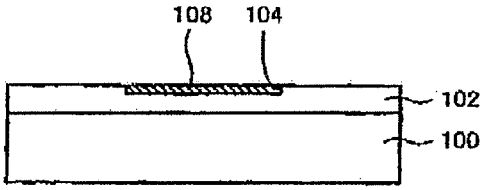
FIG. 5C is a cross-sectional view in correspondence with FIG. 5G, which is used to show a third step of manufacturing of the capacitor microphone of the first embodiment.

Next, as shown in FIGS. 5B and 5C, a recess 104 is formed in the insulating film 102. Specifically, a resist film 106 realizing the exposure of a prescribed portion corresponding to the recess 104 is formed on the insulating film 102 by way of photolithography. Herein, the resist film 106 is formed by applying a resist onto the insulating film 102. Then, the resist film 106 is subjected to exposure and development processing by use of a mask of a prescribed shape, thus removing unnecessary portions from the resist film 106. Thus, it is possible to form the resist film 106 on the insulating film 102 as shown in FIG. 5B. Unnecessary portions of the resist film 106 are removed by use of a resist peeling solution such as NMP (N-methyl-2-pyrolidone). Next, the insulating film 102 exposed from the resist film 106 is subjected to RIE (Reactive Ion Etching), thus forming the recess 104 in the insulating film 102. Then, the resist film 106 is completely removed. In the after-treatment (which will be described later), the conductive film 108 forming the diaphragm 10 is formed in the recess 104. Therefore, the recess 104 can be formed in relation to the formation of the conductive film 108.

Figure 5D:
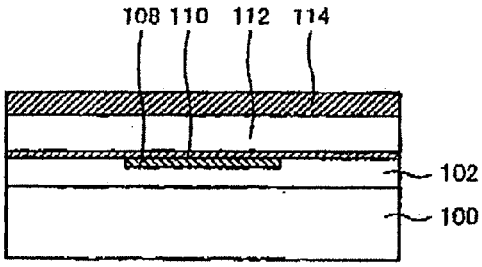
FIG. 5D is a cross-sectional view in correspondence with FIG. 5H, which is used to show a fourth step of manufacturing of the capacitor microphone of the first embodiment.
Figure 5E:
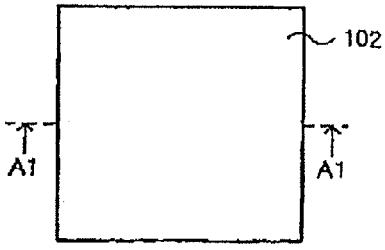
FIG. 5E is a plan view showing the capacitor microphone in correspondence with FIG. 5A.
Figure 5F:
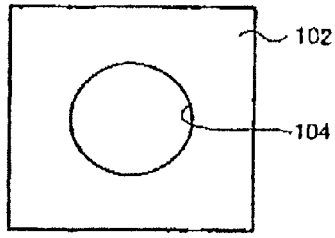
FIG. 5F is a plan view showing the capacitor microphone in correspondence with FIG. 5B.
Figure 5G:
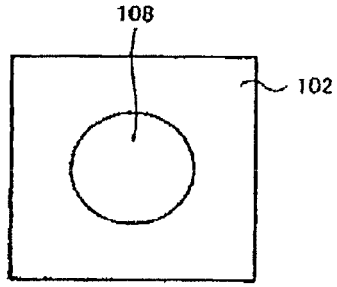
FIG. 5G is a plan view showing the capacitor microphone in correspondence with FIG. 5C.

Next, as shown in FIGS. 5C and 5G, the conductive film 108 forming the center portion of the diaphragm 10 is formed in the recess 104 of the insulating film 102. Specifically, the recess 104 is embedded in the insulating film 102, on which a p+ polysilicon layer is formed by way of CVD. Herein, p+ polysilicon is polysilicon including acceptor impurities. More specifically, a polysilicon layer is formed on the insulating film 102 by way of CVD, and then, boron (B) ions serving as impurities are implanted into the polysilicon layer. After the ion implantation, the polysilicon layer is subjected to annealing, thus forming the p+ polysilicon layer. Both the p+ polysilicon layer and the insulating film 102 are subjected to planation by way of CMP (Chemical Mechanical Polishing), so that the p+ polysilicon layer remains only in the recess 104 on the insulating film 102. Thus, it is possible to form the conductive film 108 composed of p+ polysilicon.

Figure 5H:
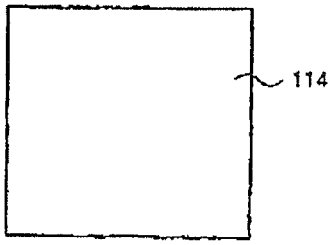
FIG. 5H is a plan view showing the capacitor microphone in correspondence with FIG. 5D.

Next, as shown in FIGS. 5D and 5H, the conductive film 110 forming the diaphragm 10 is formed to cover the surface of the insulating film 102 and the surface of the conductive film 108 by way of CVD. The conductive film 110 is a p+ polysilicon film, for example.

Next, the insulating film 112 forming the spacer 30 is formed on the conductive film 110 by way of CVD. It is preferable that the insulating film 112 be formed using the same material as the insulating film 102. By forming both the insulating films 102 and 112 with the same material, it is possible to realize an equal etching rate for them. As a result, in the following step for partially removing the insulating film (which will be described later), it is possible to easily control an etching value applied to the insulating film.

Next, the conductive film 114 forming the back plate 20 is formed on the insulating film 112 by way of CVD. The conductive film 114 is a p+ polysilicon film, for example.

Figure 6A:
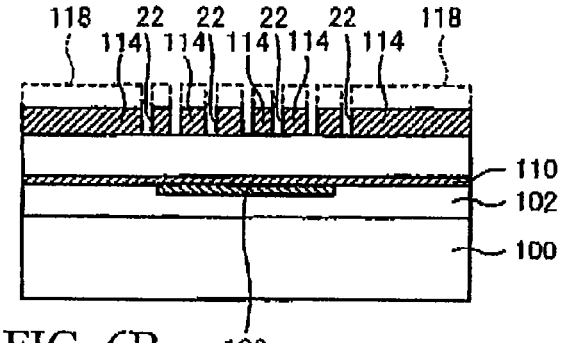
FIG. 6A is a cross-sectional in correspondence with FIG. 6E, which is used to show a fifth step of manufacturing of the capacitor microphone of the first embodiment.
Figure 6B:
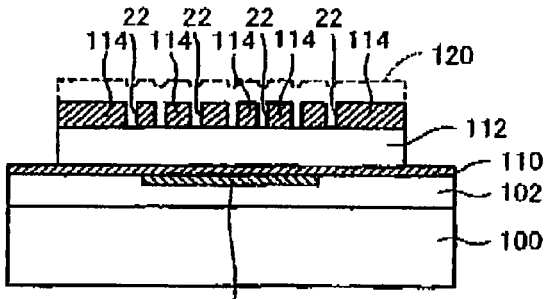
FIG. 6B is a cross-sectional view in correspondence with FIG. 6F, which is used to show a sixth step of manufacturing of the capacitor microphone of the first embodiment.
Figure 6C:
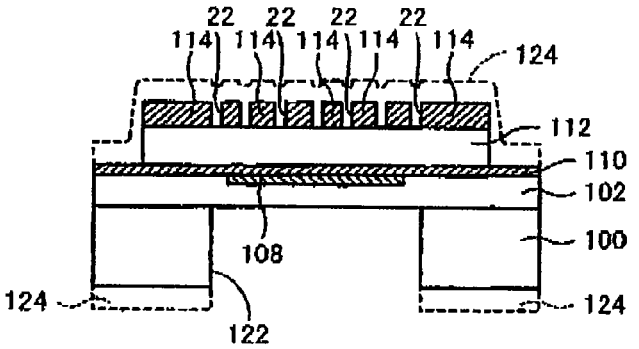
FIG. 6C is a cross-sectional view in correspondence with FIG. 6G, which is used to show a seventh step of manufacturing of the capacitor microphone of the first embodiment.
Figure 6D:
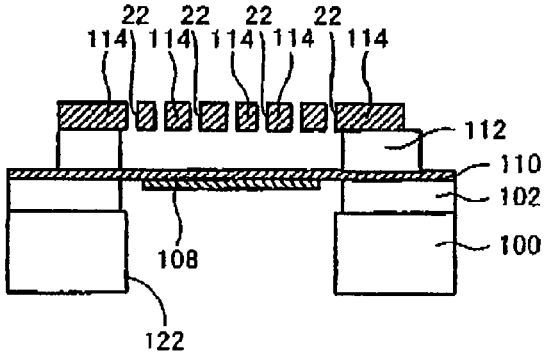
FIG. 6D is a cross-sectional view in correspondence with FIG. 6H, which is used to show an eighth step of manufacturing of the capacitor microphone of the first embodiment.
Figure 6E:
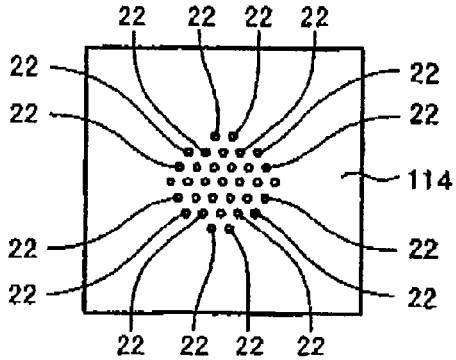
FIG. 6E is a plan view showing the capacitor microphone in correspondence with FIG. 6A.

Next, as shown in FIGS. 6A and 6E, the through holes 22 are formed in the conductive film 114. Specifically, a resist film 118 for exposing prescribed areas used for the formation of the through holes 22 is formed on the conductive film 114 by way of lithography. Next, the conductive film 114 exposed from the resist film 118 is subjected to RIE so that etching progresses to reach the insulating film 112, thus forming the through holes 22 in the conductive film 114. Then, the resist film 118 is removed.

Figure 6F:
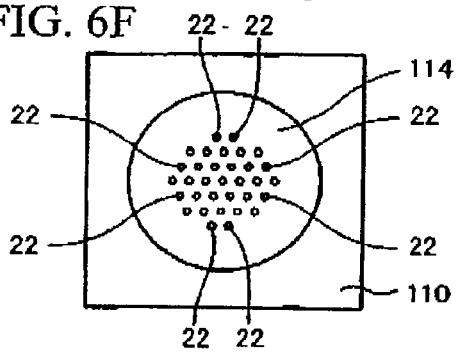
FIG. 6F is a plan view showing the capacitor microphone in correspondence with FIG. 6B.
Figure 6G:
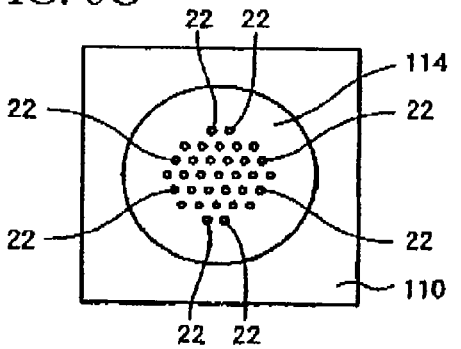
FIG. 6G is a plan view showing the capacitor microphone in correspondence with FIG. 6C.
Figure 6H:
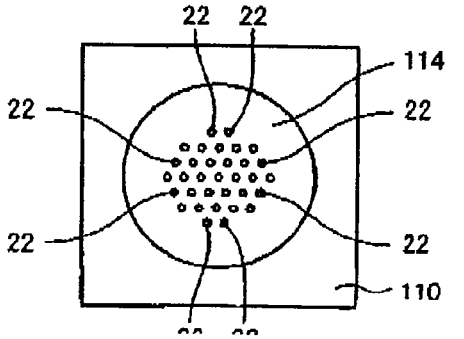
FIG. 6H is a plan view showing the capacitor microphone in correspondence with FIG. 6D.

Next, as shown in FIGS. 6B and 6F, the conductive film 110 is partially exposed. Specifically, a resist film 120 masking a remaining portion of the conductive film 114 is formed on the conductive film 114 by way of lithography. Next, the conductive film 114 exposed from the resist film 120 and the insulating film 112 are subjected to RIE so that etching progresses to reach the conductive film 110, which is thus exposed. Then, the resist film 120 is removed. Partial exposure of the conductive film 110 makes it possible to establish connection between the conductive film 110 and the detection portion.

Next, as shown in FIG. 6C, openings forming the through holes 22 are formed in the substrate 100. Specifically, a resist film 124 for exposing a prescribed portion corresponding to the openings of the substrate 100 is formed by way of the lithography. Next, the prescribed portion of the substrate 100 exposed from the resist film 124 is removed by way of deep RIE such that etching progress to reach the insulating film 102, thus forming the through holes 22 in the substrate 100. Then, the resist film 124 is removed.

Next, as shown in FIG. 6D, the insulating films 102 and 112 are removed except for a prescribed part of the insulating film 102 serving as the base 40 and a prescribed part of the insulating film 112 serving as the spacer 30. Specifically, the insulating films 102 and 112 are removed by way of wet etching. For example, an insulating film composed of $SiO_2$ is removed by use of an etching solution composed of hydrofluoric acid. The etching solution flows through the openings of the substrate 100 and the through holes 22 of the conductive film 114 so as to reach the insulating films 102 and 112, which are then dissolved. This forms the air gap 32 between the diaphragm 10 and the back plate 20, thus realizing the sound sensing portion of the capacitor microphone 1.

2. Second Embodiment

Figures 7A, 7B:
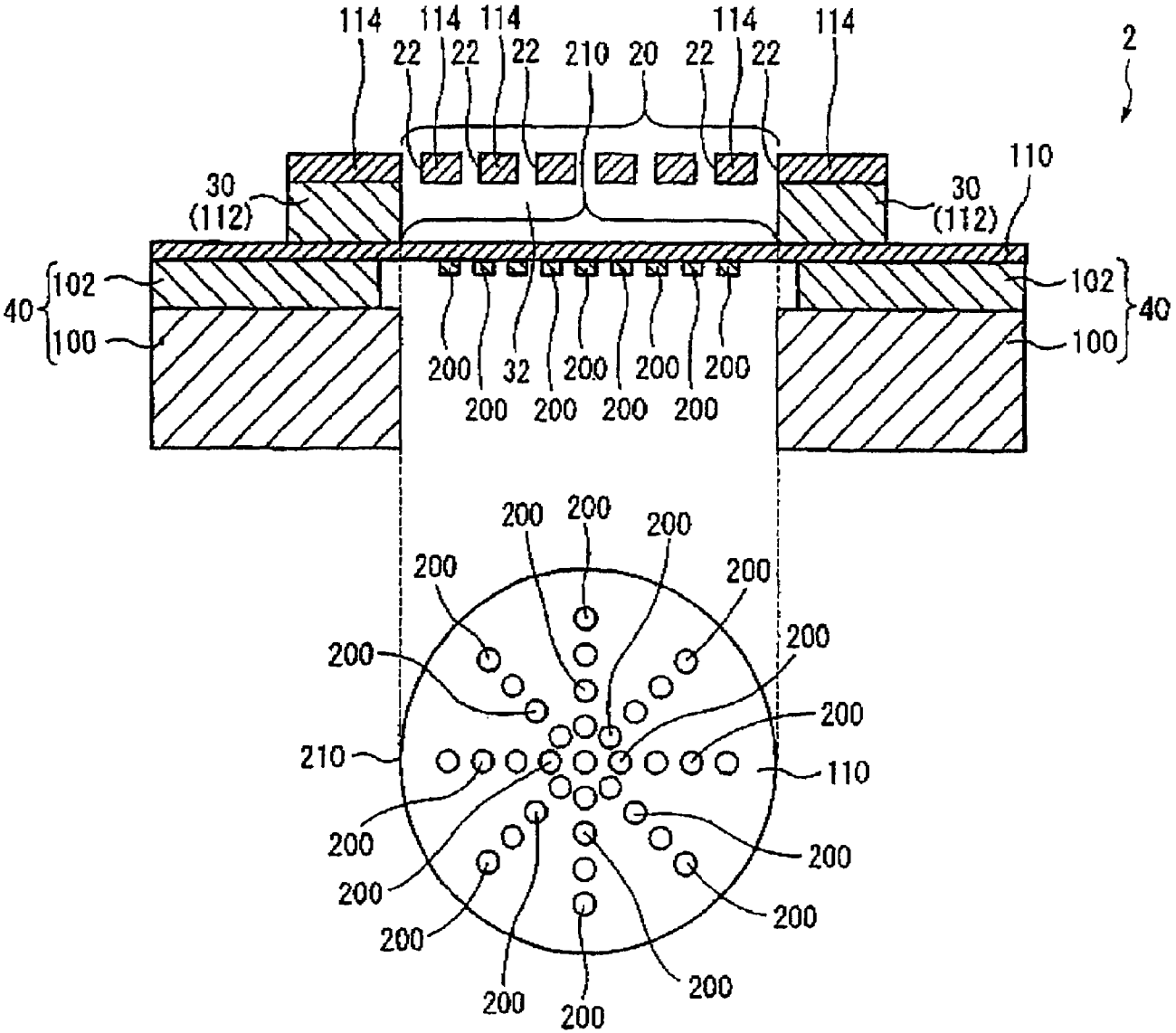
FIG. 7A is a cross-sectional view showing the constitution of a capacitor microphone in accordance with a second embodiment of the present invention.
FIG. 7B is a plan view showing a diaphragm incorporated in the capacitor microphone shown in FIG. 7A.

Next, a capacitor microphone 2 according to a second embodiment of the present invention will be described with reference to FIGS. 7A and 7B. FIG. 7A is a cross-sectional view diagrammatically showing the constitution of the capacitor microphone 2, and FIG. 7B is a lower view diagrammatically showing a diaphragm 210 incorporated in the capacitor microphone 2. The capacitor microphone 2 has a detection portion, the constitution of which is substantially identical to the constitution of the detection portion of the capacitor microphone 1.

The diaphragm 210 is constituted by a conductive film 110 and a plurality of projections 200. The projections 200 are formed using a semiconductor film (or a second film) composed of polysilicon and are positioned in a radial manner about the center of the non-fixed portion of the conductive film 110 (or a first film). The density of the projections 200 is gradually increased in a direction from the outer periphery of the diaphragm 210 to the center of the diaphragm 210. Each of the projections 200 may be realized by modifying the outline shape of the conductive film 108. The diaphragm 210 has a thin portion realized by only the conductive film 110 and a thick portion realized by both of the conductive portion 110 and the projections 200.

Figure 8A:
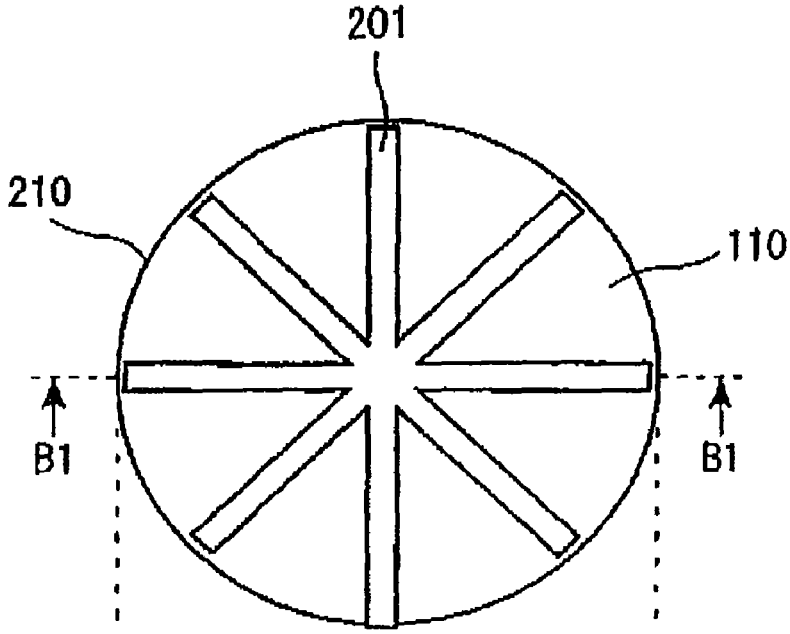
FIG. 8A is a plan view showing a variation of the diaphragm incorporated in the capacitor microphone shown in FIG. 7A.
Figure 8B:
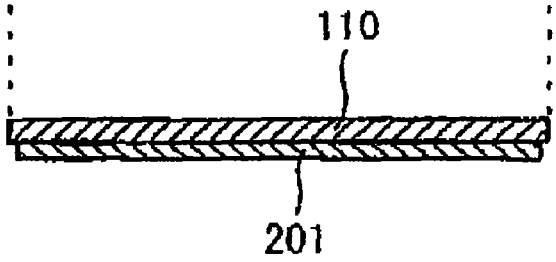
FIG. 8B is a cross-sectional view simply showing the structure of the diaphragm shown in FIG. 8A.

The second film is required to have a density that is gradually increased in a direction from the outer periphery of the diaphragm 210 to the center of the diaphragm 210; hence, the projections 200 are not necessarily required. In addition, the projections 200 are not necessarily positioned in a radial manner. Furthermore, the projections 200 are not necessarily formed in the illustrated shapes. For example, it is possible to modify the diaphragm 210 as shown in FIGS. 8A and 8B, in which projections 201 are each linearly elongated and are arranged in a radial manner about the center of the diaphragm 210. As shown in FIG. 7B, the projections 200 can be arranged in the conductive film 110 in proximity to the side of the back plate 20. Alternatively, they can be arranged in the conductive film 110 in proximity to the side of the base 40. Of course, the projections 200 can be formed on both sides of the conductive film 110. Incidentally, the diaphragm 210 can be formed using the conductive film 110 and the projections 200 in correspondence with insulating films and electrodes.

The second embodiment is advantageous in that the weight of the diaphragm 210 can be reduced; hence, it is possible to further improve the sensitivity of the capacitor microphone 2 in response to high-frequency sound.

Figure 9:
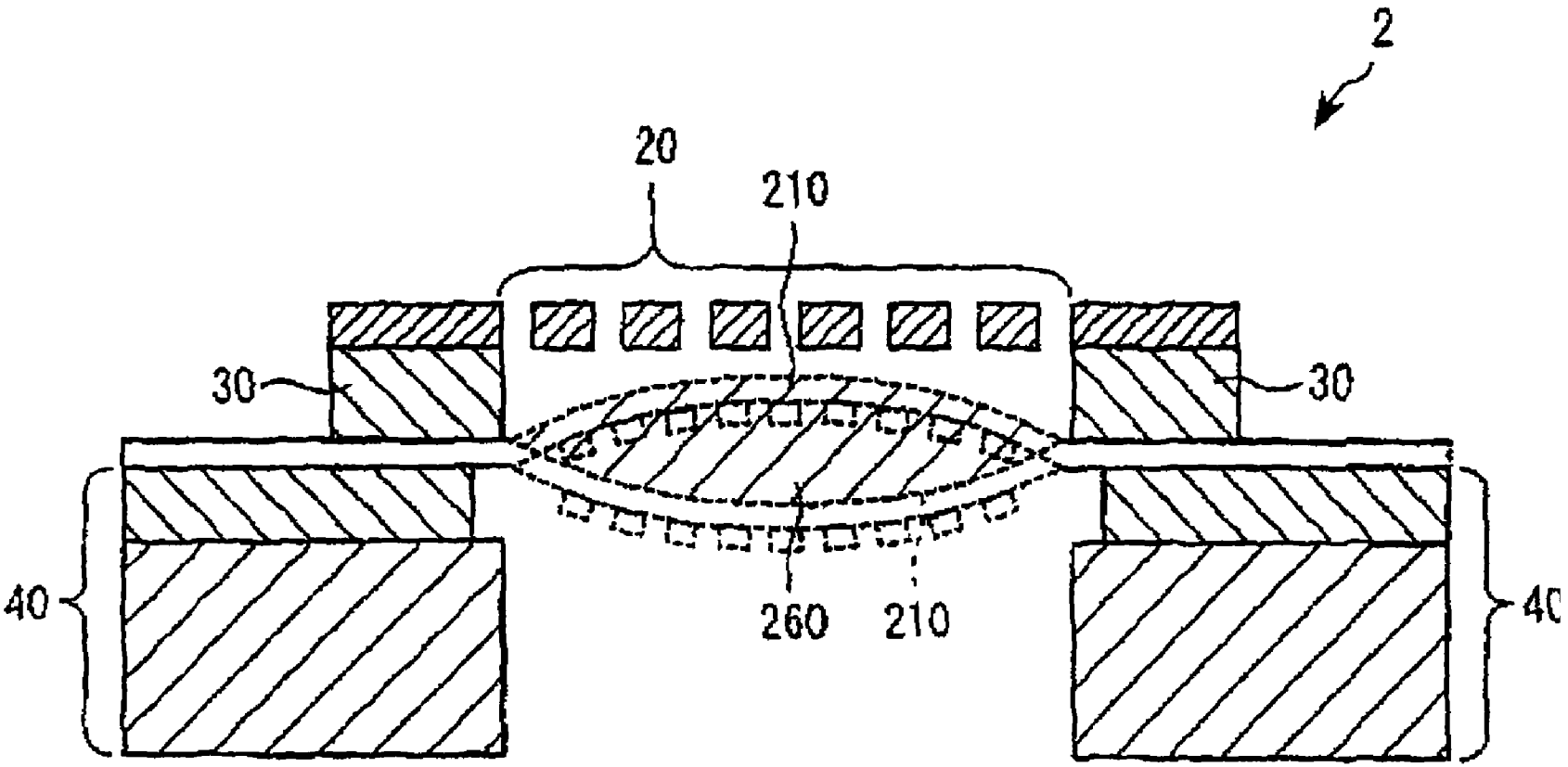
FIG. 9 is a cross-sectional view showing the operation of the capacitor microphone of the second embodiment.

Next, the operation of the capacitor microphone 2 will be described with reference to FIG. 9.

As described above, the density of the projections 200 is gradually increased in the direction from the outer periphery of the diaphragm 210 to the center of the diaphragm 210; hence, the rigidity of the diaphragm 210 is gradually increased in the direction from the outer periphery of the diaphragm 210 to the center of the diaphragm 210. For this reason, as the diaphragm 210 is smoothly deformed in response to sound waves, it vibrates such that the center portion thereof is held substantially in parallel to the back plate 20.

That is, the center portion of the diaphragm 210 vibrates substantially with the maximum displacement while it is held substantially in parallel with the back plate 20. Hence, it is possible to increase the total displacement of the diaphragm 210 (see a hatched area 260 in FIG. 9) in comparison with the total displacement of the foregoing diaphragm having the uniform rigidity (see the hatched area 46 in FIG. 4). This improves the sensitivity of the capacitor microphone 2 while avoiding the occurrence of a pull-in event.

As described above, the diaphragm 210 vibrates while being smoothly deformed. That is, the stress applied to the diaphragm 210 being deformed is entirely distributed over the diaphragm 210; hence, it is possible to reduce the thickness of the diaphragm 210. Due to the reduced thickness of the diaphragm 210, it is possible to reduce the rigidity of the diaphragm 210 entirely; hence, it is possible to vibrate the diaphragm 210 with a relatively large amplitude. Due to the reduced thickness of the diaphragm 210, it is possible to reduce the weight of the diaphragm 210; hence, it is possible to further improve the sensitivity of the capacitor microphone 2 in response to high-frequency sound.

Figure 10A:
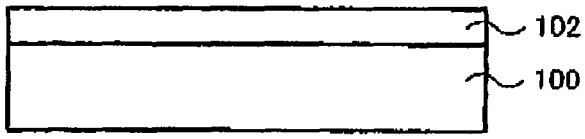
FIG. 10A is a cross-sectional view taken along line A2-A2 in FIG. 10E, which is used to show a first step of manufacturing of the capacitor microphone of the second embodiment

Next, a manufacturing method of the capacitor microphone 2 will be described with reference to FIGS. 10A to 10H. FIG. 10A is a cross-sectional view taken along line A2-A2 in FIG. 10E. Similar to the first step of the manufacturing method applied to the capacitor microphone 1 of the first embodiment, as shown in FIG. 10A, an insulating film 102 is formed on a substrate 100.

Figure 10B:
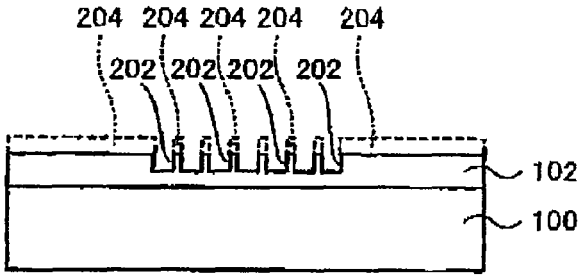
FIG. 10B is a cross-sectional view in correspondence with FIG. 10F, which is used to show a second step of manufacturing of the capacitor microphone of the second embodiment.
Figure 10C:
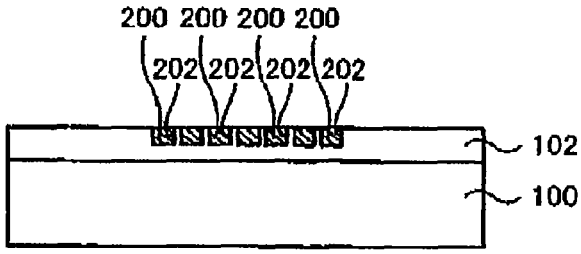
FIG. 10C is a cross-sectional view in correspondence with FIG. 10G, which is used to show a third step of manufacturing of the capacitor microphone of the second embodiment.
Figure 10D:
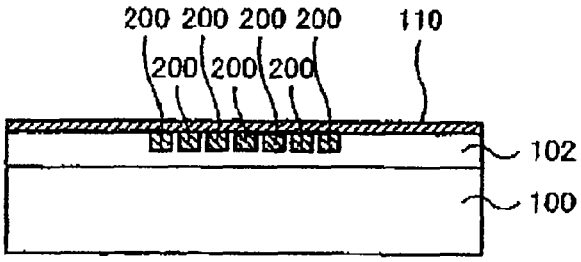
FIG. 10D is a cross-sectional view in correspondence with FIG. 10H, which is used to show a fourth step of manufacturing of the capacitor microphone of the second embodiment.
Figure 10E:
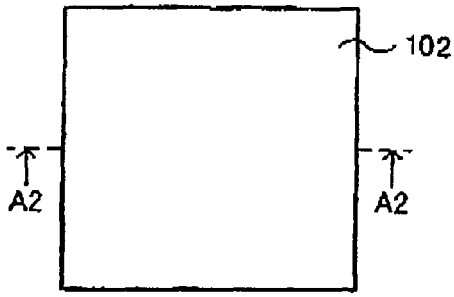
FIG. 10E is a plan view showing the capacitor microphone in correspondence with FIG. 10A.
Figure 10F:
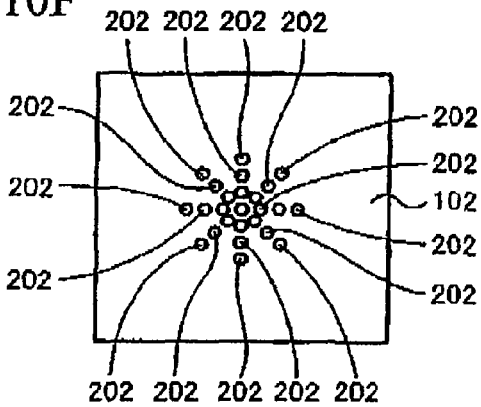
FIG. 10F is a plan view showing the capacitor microphone in correspondence with FIG. 10B.

Next, as shown in FIGS. 10B and 10F, a plurality of recesses 202 are formed in the insulating film 102. Specifically, a resist film 204 for exposing prescribed portions of the insulating film 102 in correspondence with the recesses 202 is formed on the insulating film 102 by way of lithography. Then, the exposed portions of the insulating film 102 exposed from the resist film 204 are subjected to RIE, thus forming the recesses 202 in the insulating film 102. Thereafter, the resist film 204 is removed. In the after-treatment (which will be described later), a plurality of the projections 200 incorporated in the diaphragm 210 is formed in the recesses 202; hence, the recesses 202 can be formed in prescribed shapes suiting the shapes of the projections 200.

Figure 10G:
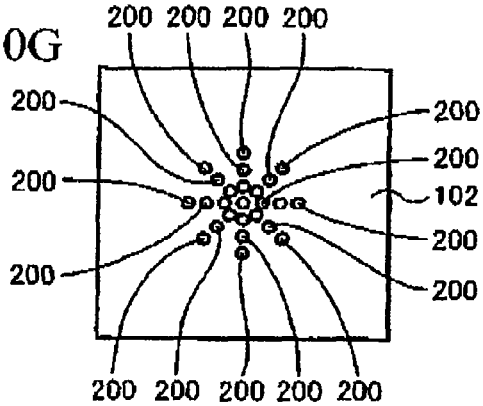
FIG. 10G is a plan view showing the capacitor microphone in correspondence with FIG. 10C.
Figure 10H:
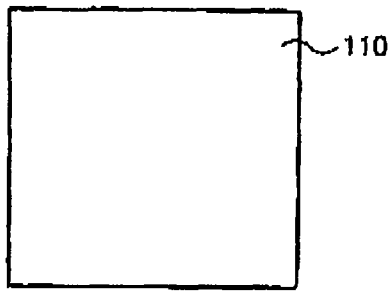
FIG. 10H is a plan view showing the capacitor microphone in correspondence with FIG. 10D.

That is, as shown in FIGS. 10C and 10G, the projections 200 are formed in the recesses 202. Specifically, a p+ polysilicon film for embedding the recesses 202 is formed on the insulating film 102 by way of CVD. Then, the p+ polysilicon film and the insulating film 102 are subjected to planation by way of CMP, so that p+ polysilicon remains only in the recesses 202 of the insulating film 102. This makes it possible to form the projections 200 composed of p+ polysilicon.

Next, as shown in FIG. 10D, the conductive film 110 is formed to cover the insulating film 102 and the surfaces of the projections 200 by way of CVD. The following steps of the manufacturing method applied to the capacitor microphone 2 of the second embodiment are substantially identical to those of the aforementioned manufacturing method applied to the capacitor microphone 1 of the first embodiment.

3. Third Embodiment

Figure 11A:
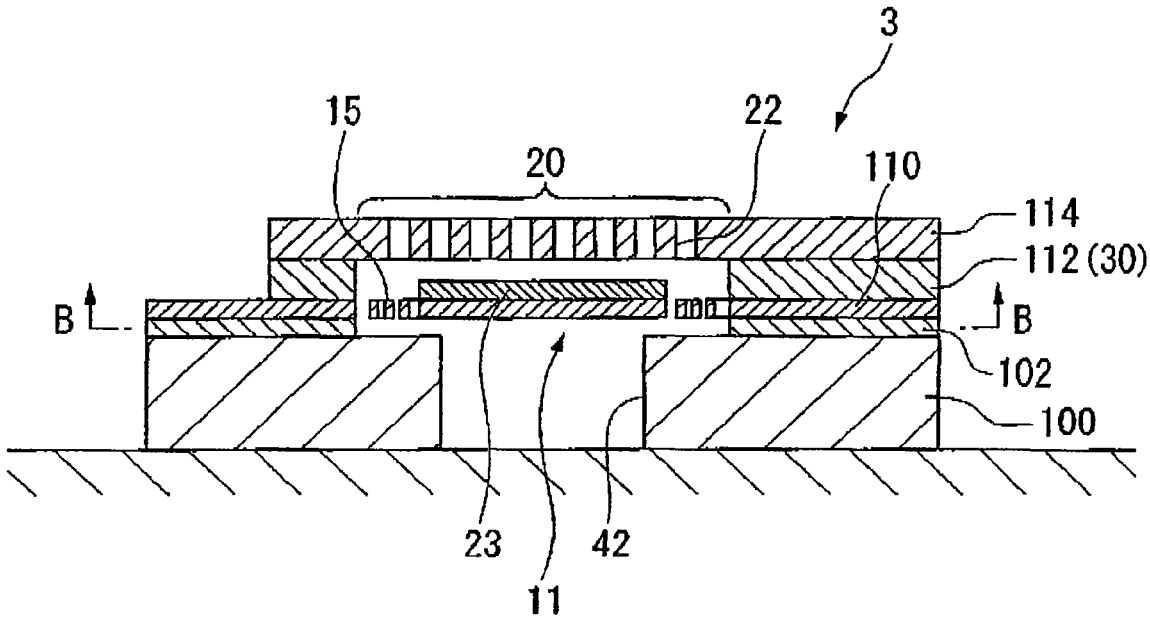
FIG. 11A is a cross-sectional view showing the constitution of a capacitor microphone in accordance with a third embodiment of the present invention.
Figure 11B:
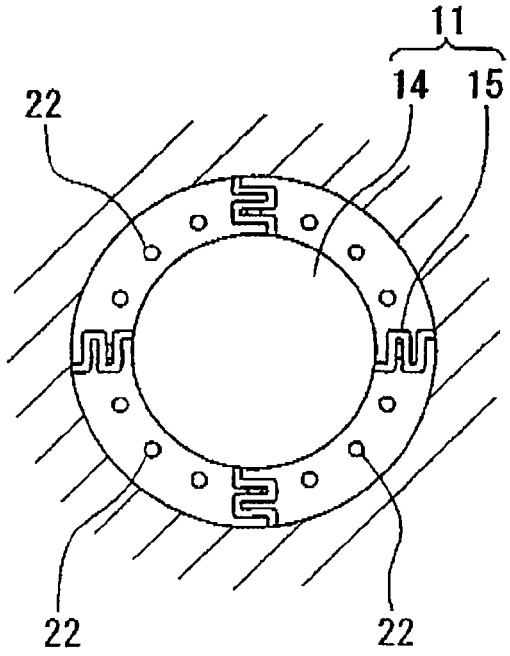
FIG. 11B is a cross-sectional view taken along line B-B in FIG. 11A, which shows the configuration of a diaphragm incorporated in the capacitor microphone of the third embodiment.

Next, a capacitor microphone 3 according to a third embodiment of the present invention will be described with reference to FIGS. 11A and 11B. Herein, a center portion 14 of a diaphragm 11 has a two-layered structure including a conductive film 23 and a conductive film 110. The conductive film 110 functions as a reinforcement film, which increases the rigidity of the center portion 14 of the diaphragm 11 and is formed to entirely cover the center portion 14. A plurality of near-end portions 15 are formed in the diaphragm 11 by use of the conductive film 110, wherein they act as bridge structures for interconnecting the center portion 14 to the spacer 30. The near-end portions 15 are each bent and folded in a zigzag manner so as to function as springs. For this reason, the rigidity of the near-end portions 15 is extremely reduced in comparison with the rigidity of the center portion 14, so that the deformation of the diaphragm 11 transmitting sound waves must be concentrated at the near-end portions 15. Even when sound waves are transmitted through the diaphragm 11, the center portion 11 is not substantially deformed; hence, the center portion 14 vibrates substantially in parallel motion.

Since the near-end portions 15 are reduced in amplitude in comparison with the center portion 14, the average parasite capacity formed by the near-end portions 15 in unit area must be increased in comparison with the center portion 14. In the third embodiment in which the conductive film 23 joins the conduction film 110 in proximity to the back plate 20, the distance between the back plate 20 and the diaphragm 11 becomes small in proximity to the center portion 14 but becomes large in proximity to the near-end portions 15. As a result, the capacitor microphone 3 of the third embodiment is advantageous in that the parasite capacitance can be reduced in comparison with the capacitor microphone 1 of the first embodiment.

4. Fourth Embodiment

Figure 12A:
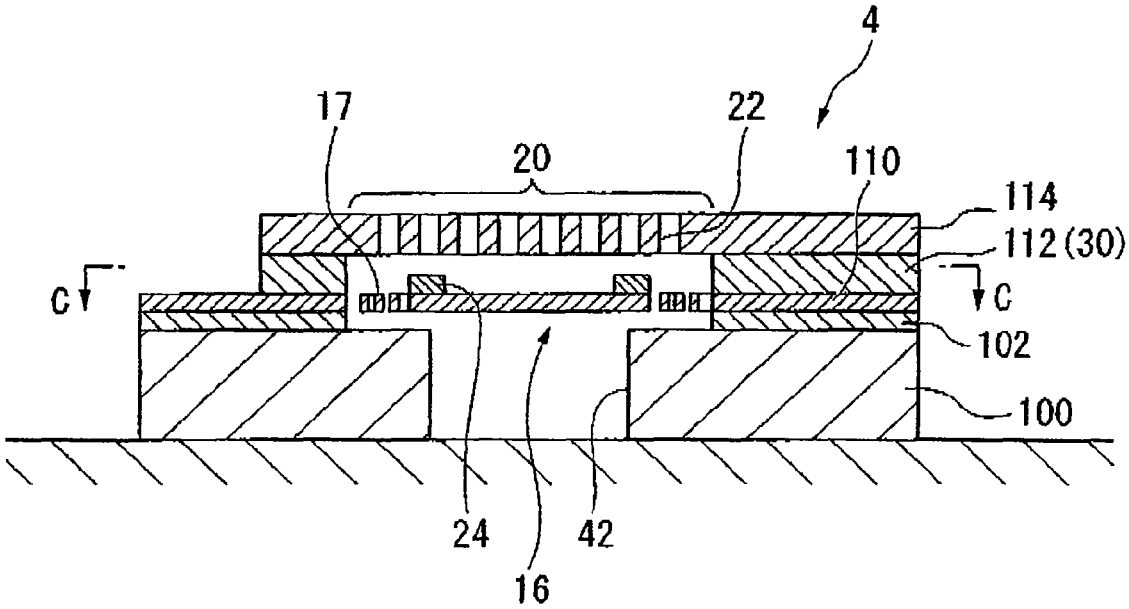
FIG. 12A is a cross-sectional view showing the constitution of a capacitor microphone in accordance with a fourth embodiment of the present invention.
Figure 12B:
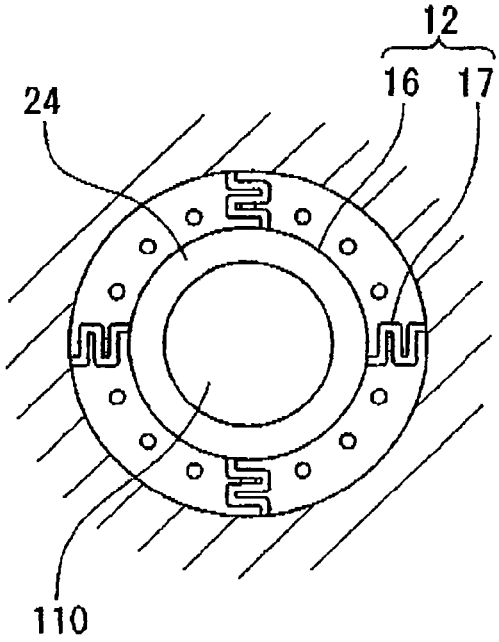
FIG. 12B is a cross-sectional view taken along line C-C in FIG. 12A, which shows the configuration of a diaphragm incorporated in the capacitor microphone of the fourth embodiment.

FIGS. 12A and 12B show a capacitor microphone 4 according to a fourth embodiment of the present invention. The fourth embodiment is characterized in that a conductive film 24 having a ring-like shape is formed in the periphery of a center portion 116 of a diaphragm 12, which is thus increased in rigidity.

5. Fifth Embodiment

Figure 13A:
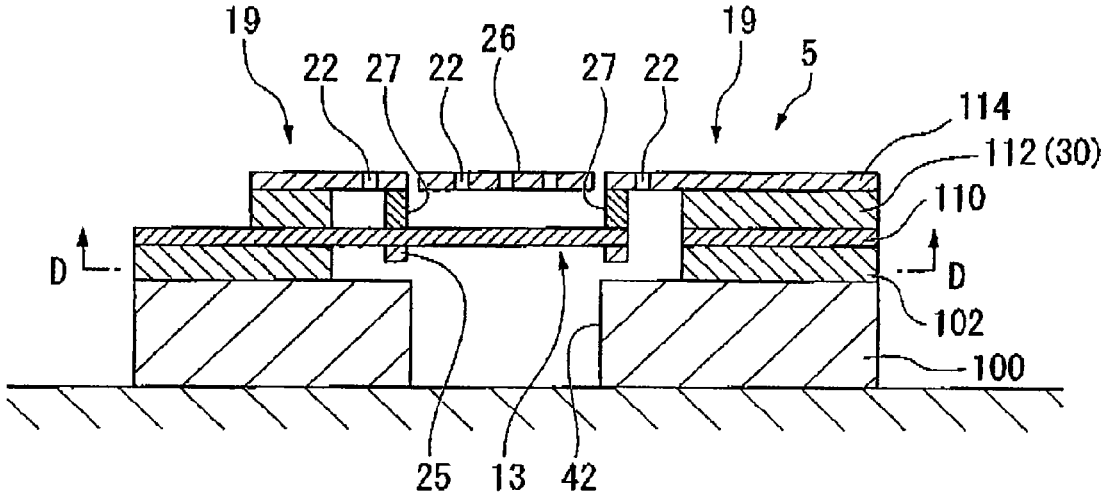
FIG. 13A is a cross-sectional view showing the constitution of a capacitor microphone in accordance with a fifth embodiment of the present invention.
Figure 13B:
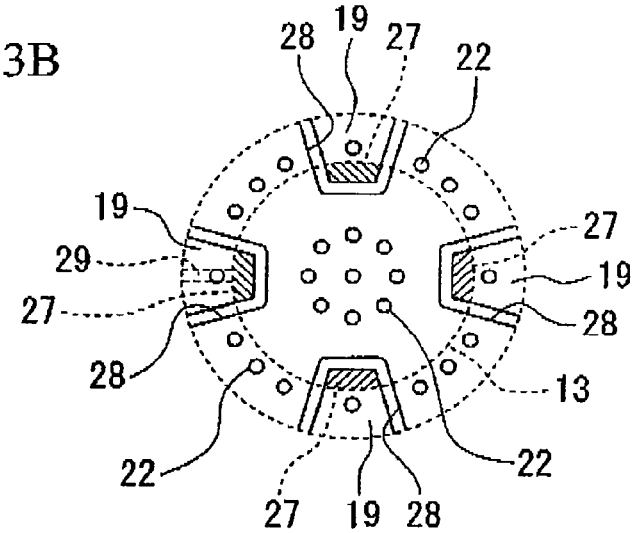
FIG. 13B is cross-sectional view taken along line D-D in FIG. 13A, which shows the configuration of a back plate in relation to a diaphragm incorporated in the capacitor microphone of the fifth embodiment.
Figure 13C:
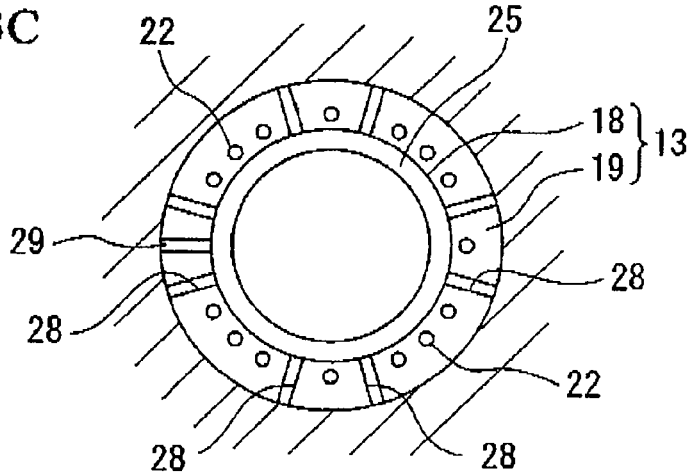
FIG. 13C is a cross-sectional view taken along line D-D in FIG. 13A, which shows the configuration of the diaphragm in relation to the back plate incorporated in the capacitor microphone of the fifth embodiment.

FIGS. 13A, 13B, and 13C show a capacitor microphone 5 in accordance with a fifth embodiment of the present invention. Herein, a center portion 18 of a diaphragm 13 is hung by a near-end portion 19. The near-end portion 19 is constituted by a connection portion 27 (which is formed using a part of an insulating film 112) and a conductive film 114, thus supporting the center portion 18 at plural positions. The back plate 20 is mechanically separated from the near-end portion 19 of the diaphragm 13 by means of cutouts 28. The near-end portion 19 allows the diaphragm 13 to be contacted in response to stress, which occurs in manufacturing, wherein due to the contraction, it is possible to reduce the stress applied to the diaphragm 13. A conductive film 25 having a ring-like shape is formed in the periphery of the center portion 18 in order to increase the rigidity of the diaphragm 13. Since the conductive film 25 is used to increase the rigidity of the center portion 18 of the diaphragm 13, it can be formed using an insulating film composed of SiN and SiON, for example.

6. Sixth Embodiment

Figure 14A:
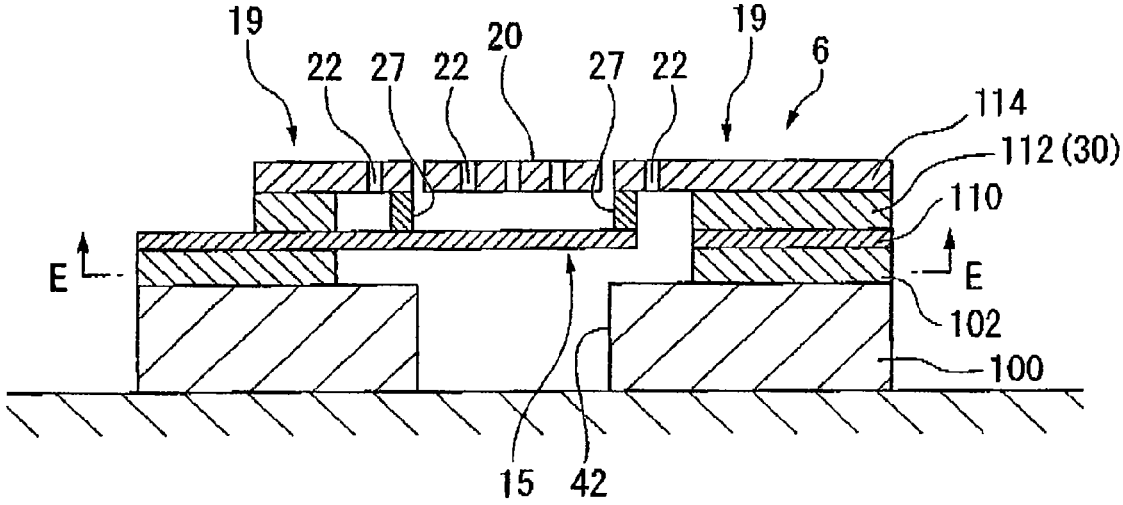
FIG. 14A is a cross-sectional view showing the constitution of a capacitor microphone in accordance with a sixth embodiment of the present invention.
Figure 14B:
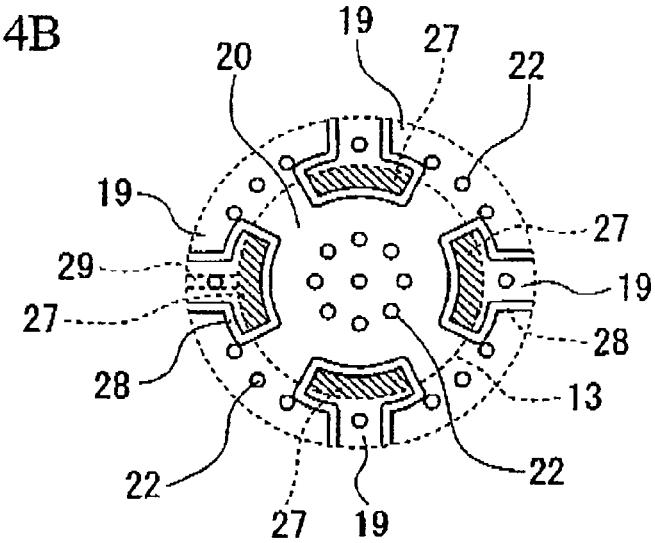
FIG. 14B is cross-sectional view taken along line E-E in FIG. 14A, which shows the configuration of a back plate in relation to a diaphragm incorporated in the capacitor microphone of the sixth embodiment.
Figure 14C:
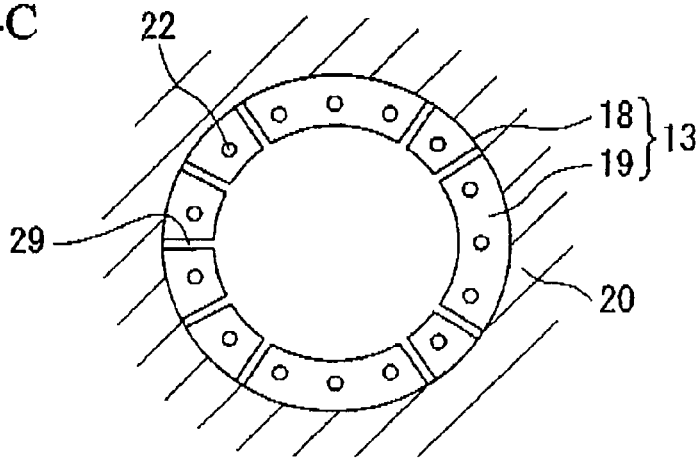
FIG. 14C is a cross-sectional view taken along line E-E in FIG. 14A, which shows the configuration of the diaphragm in relation to the back plate incorporated in the capacitor microphone of the sixth embodiment.

FIGS. 14A, 14B, and 14C show a capacitor microphone 6 in accordance with a sixth embodiment of the present invention, wherein parts identical to those shown in FIGS. 13A to 13C are designated by the same reference numerals.

That is, the fifth embodiment is modified into the sixth embodiment in such a way that the rigidity of the center portion 18 of the diaphragm 13 is increased by means of the connection portions 27. Herein, the connection portions 27 are each elongated in length in a circumferential direction in comparison with the connection portions 27 adapted to the fifth embodiment, wherein the connection portions 27 are arranged in a ring-like shape so as to form the outer periphery of the center portion 18. Even when the connection portions 27 are distanced from each other in the circumferential direction of the center portion 18 of the diaphragm 13, the total rigidity of the center portion 18 can be increased because the outer periphery thereof is substantially connected together by means of the connection portions 27. The sixth embodiment is advantageous in that a reinforcing member (which may be needed for the fifth embodiment) is not necessarily arranged with respect to the outer periphery in the opposite side of the back plate 20 positioned relative to the center portion 18 of the diaphragm 13.

Since the connection portions 27 are each elongated in length in a circumferential direction, the rigidity of the back plate 20 may be decreased. To cope with such a minor drawback, it is preferable to increase the thickness of the back plate 20. Specifically, it is preferable that the thickness of the back plate 20 be increased to be larger than the thickness of the near-end portion 19 of the diaphragm 13.

7. Variations

The rigidity of the diaphragm composed of the semiconductor film can be controlled by ion implantation of impurities. Specifically, it is possible to perform ion implantation using impurities into the center portion of the diaphragm so as to increase the rigidity of the semiconductor film. Alternatively, it is possible to perform ion implantation using impurities into the near-end portion of the diaphragm so as to reduce the rigidity of the semiconductor film. Thus, similar to the diaphragm 10 of the capacitor microphone 1 of the first embodiment, it is possible to obtain the diaphragm whose center portion vibrates with the maximum displacement in response to sound waves. Specifically, C ions are implanted into the center portion of the diaphragm composed of Si so as to form SiC, which thus increases the rigidity of the center portion of the diaphragm. In addition, it is possible to implant Ar ions into the near-end portion of the diaphragm at a high dose, wherein Ar ions are introduced between Si crystals forming the near-end portion of the diaphragm so as to reduce the bonding strengths between Si crystals, thus reducing the rigidity at the center portion of the diaphragm. Alternatively, it is possible to perform ion implantation using impurities (which reduce the rigidity of the semiconductor film) into the diaphragm in such a way that the ratio between the implanted region and non-implanted region is gradually increased in the direction from the center portion to the outer periphery of the diaphragm. Thus, similar to the diaphragm 10 incorporated in the capacitor microphone 2 of the second embodiment, it is possible to obtain the diaphragm that is smoothly deformed in response to sound waves and whose center portion vibrates with the maximum displacement.

8. Seventh Embodiment

Figure 15A:
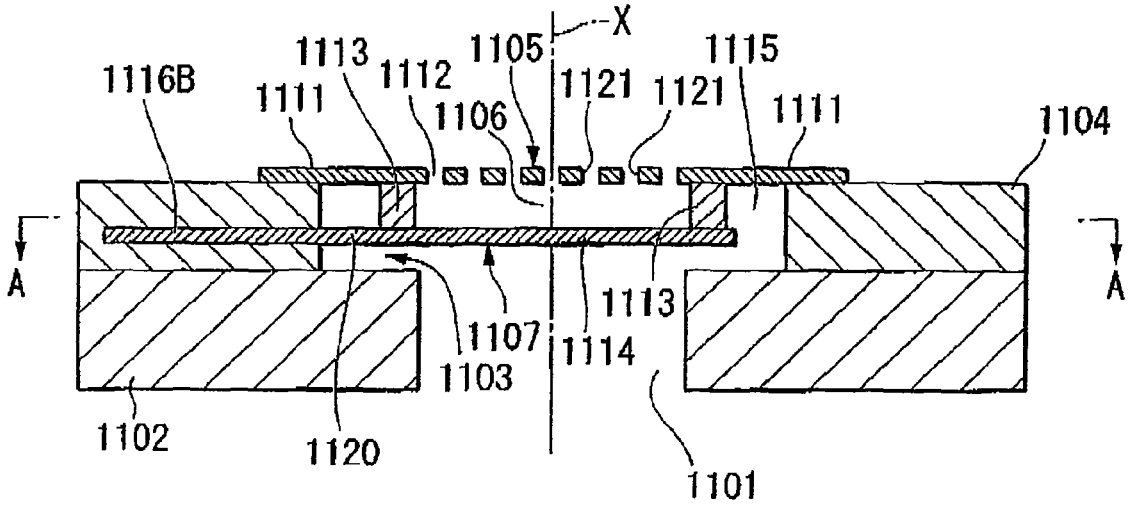
FIG. 15A is a cross-sectional view taken along line B-B in FIG. 15B, which shows the constitution of a capacitor microphone in accordance with a seventh embodiment of the present invention.
Figure 15B:
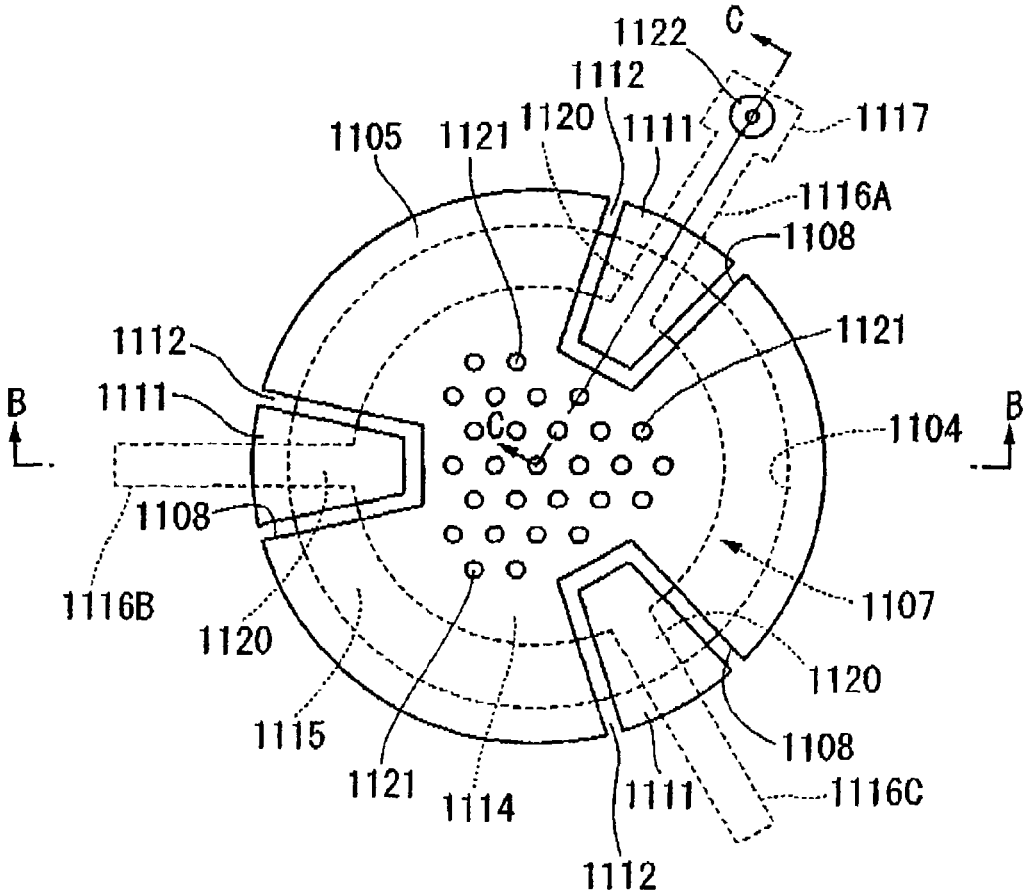
FIG. 15B is a plan view showing a fixed electrode and support members incorporated in the capacitor microphone.

FIGS. 15A and 15B show a capacitor microphone in accordance with a seventh embodiment of the present invention. On a semiconductor substrate 1102 having a block-like shape in which a hollow 1101 is formed at the center thereof, a ring-shaped insulating layer 1104 having an internal space 1103 that is larger than the hollow 1101 is arranged to surround the periphery of the hollow 1101; the outer periphery of a fixed electrode 1105 having a plate-like shape is fixed to the upper surface of the insulating layer 1104; and a diaphragm electrode 1107 is supported in parallel with the fixed electrode 1005 by way of an air gap 1106.

The fixed electrode 1105 as a whole is formed in a circular plate-like shape whose diameter is larger than that of the internal space 1103 of the insulating layer 1104. As shown in FIG. 15B, three recesses 1108 are formed to partially cut out the outer periphery of the fixed electrode 1105 at three positions that are distanced from each other with an angle of 120° therebetween in a circumferential direction, wherein support members 1111 each having a tongue-like shape are held inside of the recesses 1108 and are each slightly distanced from the fixed electrode 1105 with certain air gaps therebetween. That is, the support members 1111 are arranged in the recesses 1107 of the fixed electrode 1105 so as to form bent slits 1112 between the support members 1111 and the fixed electrode 1105. The outer periphery of the fixed electrode 1105 except the support members 1111 is fixedly attached to the insulating layer 1104, and the outer terminals of the support members 1111 are fixedly attached to the insulating layer 1104, whereby the inner terminals of the support members 1111 are inwardly extended from the insulating layer 1104 into the inner space 1103 in a radius direction.

The inner terminals of the support members 1111 are interconnected to the outer periphery of the diaphragm electrode 1107 at three positions via interconnection poles 1113 each composed of an insulating substance. The diaphragm electrode 1107 as a whole is formed in a circular shape, and the outer periphery of a circular plate 1114 is fixed to the support members 1111 at three positions via the interconnection poles 1113; hence, the diaphragm electrode 1107 is supported by the support members 1111 and is hung in the hollow 1101. The circular plate 1114 of the diaphragm electrode 1107 is formed in a circular plate-like shape whose inner diameter is smaller than that of the inner space 1103 of the insulating layer 1104. In addition, a ring-shaped space 1115 is formed between the outer periphery of the circular plate 1114 and the interior wall of the insulating layer 1104.

Figure 16:
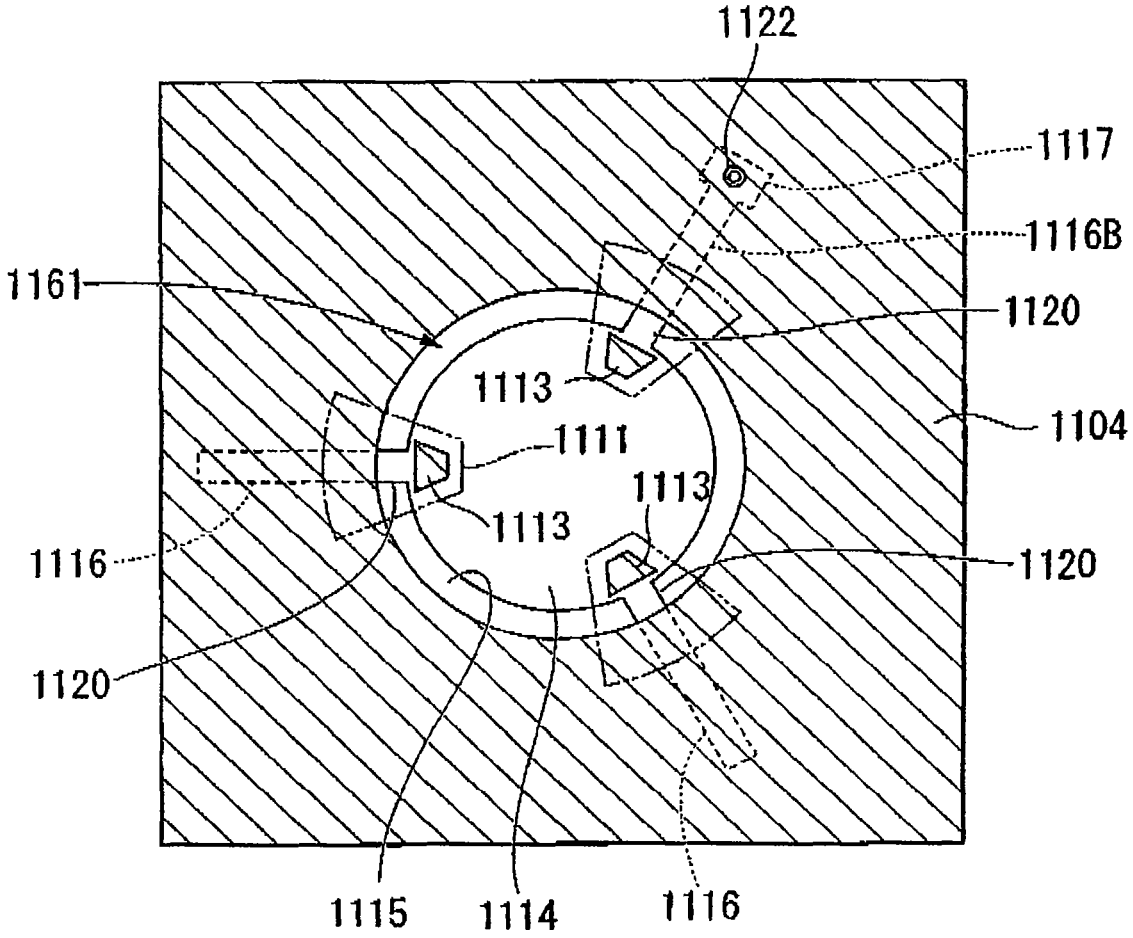
FIG. 16 is a plan view showing a cross section taken along line A-A in FIG. 15A.

As shown in FIG. 15B and FIG. 16, three extension arms 1116A to 1116C each extended outwardly in a radius direction are integrally formed with the outer circumferential periphery of the circular plate 1114. The extension arms 1116A to 1116C traversing the ring-shaped space 1115 are embedded in the insulating layer 1104, and a land 1107 is formed at a projected end of the extension arm 1116A.

As shown in FIG. 15B and FIG. 16, the extension arms 1116A to 1116C are formed to suit the positions of the interconnection poles 1113, so that they are distanced from each other with an angle of 120° in a circumferential direction. All the extension arms 116A to 1116C are formed with the same dimensions (e.g., the same width) except for the land 1117.

Both of the fixed electrode 1105 and the diaphragm electrode 1117 are formed using conductive semiconductor films composed of polycrystal silicon (or polysilicon). The diaphragm electrode 1107 is formed like a thin film that can vibrate in response to sound waves. Impurities composed of phosphorus (P) are doped into bridge portions of the extension arms 1116A to 1116C, which are bridged over and connected to the circular plate 1014 and the insulating layer. The bridge portions serve as stress adjusted portions 1120 in which residual tensile stress is reduced in comparison with other portions. A plurality of through holes 1121 for transmitting sound waves are uniformly formed in the center portion of the fixed electrode 1105 except for its outer periphery. As shown in FIG. 15A, both of the fixed electrode 1105 and the circular plate 1114 of the diaphragm electrode 1107 are disposed along the same axial line X.

The insulating layer 1104 is laminated in a ring-like manner on the outer periphery of the semiconductor substrate 1102 except the inner portion in proximity to the hollow 1101. All of the insulating layer 1104 and the interconnection poles 1113 are composed of insulating substances such as silicon oxide.

Figure 17:
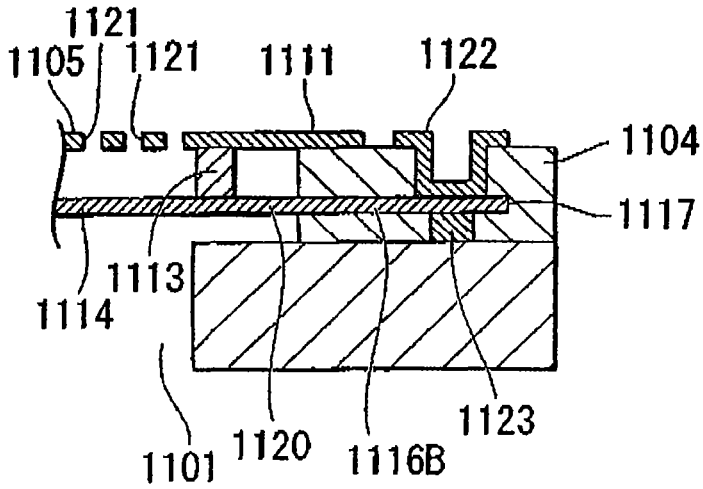
FIG. 17 is a cross-sectional view taken along line C-C in FIG. 15B.

As shown in FIG. 17, an input terminal 1122 (which is connected to an external device, not shown) is connected to the land 1117 projected at the tip end of the extension terminal 116A of the diaphragm electrode 1107 and is exposed on the upper surface. In addition, a conduction portion 1123 for connecting the land 1117 to the semiconductor substrate 1102 is formed in contact with the backside of the land 1117. Furthermore, an output terminal (not shown) is formed at the fixed electrode 1115.

Next, the manufacturing method of the capacitor microphone 1101 will be described with reference to FIGS. 18A to 18F, which show the transition of the cross-sectional structures regarding the extension terminal 16A taken along line C-C in FIG. 15B.

(a) Lamination Step

Figure 18A:
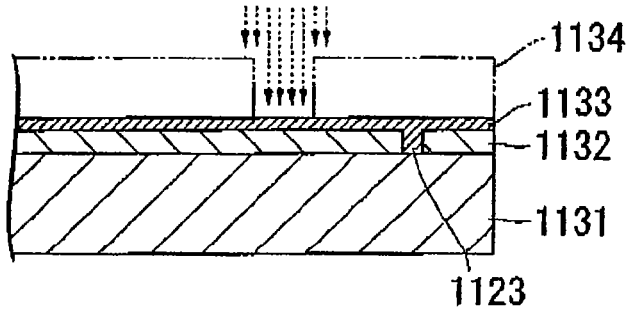
FIG. 18A is a cross-sectional view showing a first step for manufacturing the capacitor microphone in connection with a cross section taken along line C-C in FIG. 15B.

First, as shown in FIG. 18A, the surface of a plate substrate 1131 composed of monocrystal silicon, which serves as the semiconductor substrate 1102, is subjected to thin-film formation techniques such as CVD (Chemical Vapor Deposition) so as to deposit insulating substances such as silicon oxide ($SiO_2$), thus forming a first insulating layer 1132.

Next, a conductive layer 1133 composed of polysilicon, which serves as the diaphragm electrode 1107, is formed on the first insulating layer by way of CVD. A resist layer 1134 is formed to entirely cover the conductive layer except for prescribed positions, which serve as the bridge portions of the extension arms 1116A to 1116C of the diaphragm electrode 1107 (see dashed lines in FIG. 18A). Impurities such as phosphorus (P) are doped into the bridge portions by way of ion implantation.

Next, the resist layer 1134 is removed; then, the in-process structure is subjected to annealing at a prescribed temperature ranging from 800° C. to 900° C. by use of an RTA (Rapid Thermal Annealing) device, for example.

At the position of the land 1117 formed at the tip end of the extension arm 1116A of the diaphragm electrode 1117A, a through hole is formed to run through the first insulating layer 1132, and the conductive layer 1133 is partially filled in the through hole, thus integrally forming a conduction portion 1122 for establishing connection between the conductive layer 1133 and the plate substrate 1131.

Figure 18B:
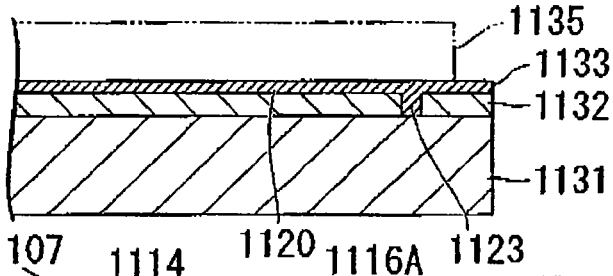
FIG. 18B is a cross-sectional view showing a second step for manufacturing the capacitor microphone.
Figure 18C:
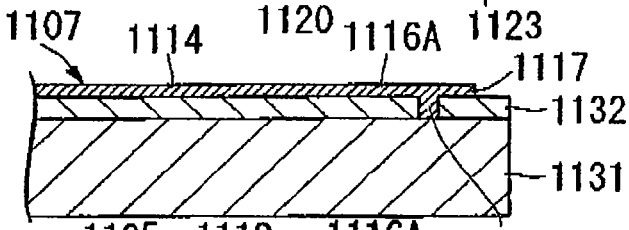
FIG. 18C is a cross-sectional view showing a third step for manufacturing the capacitor microphone.
Figure 18D:
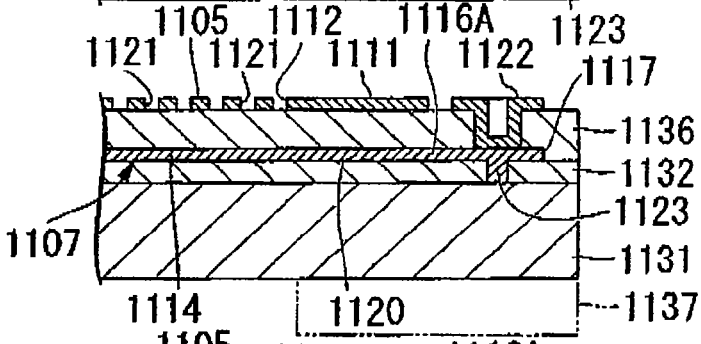
FIG. 18D is a cross-sectional view showing a fourth step for manufacturing the capacitor microphone.

A resist is applied onto the conductive layer 1133 and is then subjected to exposure and development processing, thus forming a resist layer 1135 covering the prescribed area serving as the diaphragm electrode 1117 (see FIG. 18B). The diaphragm electrode 1107 is formed by way of etching such as RIE (Reactive Ion Etching). Thereafter, a resist peeling solution is used to remove the resist layer 1135; thus, it is possible to produce the in-process structure shown in FIG. 18C.

Next, an insulating substance composed of silicon oxide is deposited to entirely cover the diaphragm 1107 by way of CVD, thus forming a second insulating layer 136.

In addition, a conductive layer composed of polysilicon is formed on the second insulating layer 1136 by way of CVD; thereafter, the a resist layer is formed to cover the prescribed areas (which serve as the fixed electrode 105 and the support members 1111 later) on the conductive layer and is then subjected to etching such as RIE, thus forming the fixed electrode 1105 having the through hole 121 and the support members 1111. After completion of the formation of the fixed electrode 1105 and the support members 1111, the aforementioned resist layer formed thereabove is removed, thus producing the in-process structure shown in FIG. 18D. In this state, the fixed electrode 1105 is reliably separated from the support members 1111 via the bent slits 1112 therebetween.

Above the land 1117 of the extension arm 1116A of the diaphragm electrode 1117, a through hole is formed in the second insulating layer 1136 and is subjected to plating using aluminum so as to form the input terminal 1122 for establishing connection with an external device (not shown).

(b) Hollow Forming Step

Figure 18E:
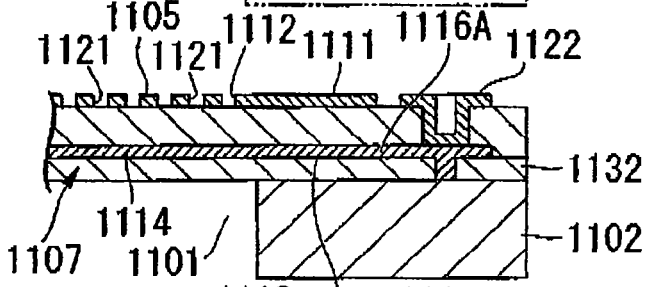
FIG. 18E is a cross-sectional view showing a fifth step for manufacturing the capacitor microphone.

A resist film 1137 (see dashed lines in FIG. 18D) is formed to cover the backside of the plate substrate 1131 except its center portion serving as the hollow 1101. Then, deep RIE is performed such that etching progresses to reach the interface between the plate substrate 1131 and the first insulating layer 1132, whereby the center portion of the plate substrate 1131 is removed, thus forming the in-process structure as shown in FIG. 18E, i.e., the semiconductor substrate 1102 having the hollow 1101. After completion of the formation of the hollow 1111, the resist layer 1137 is removed from the semiconductor substrate 1112.

(c) Wet Etching Step

Figure 18F:
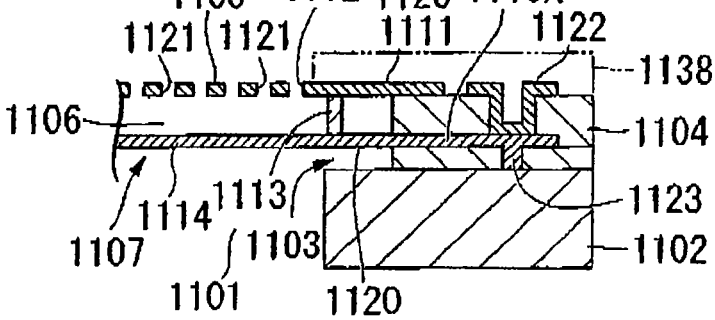
FIG. 18F is a cross-sectional view showing a sixth step for manufacturing the capacitor microphone.

Next, as shown in FIG. 18F, a resist layer 1138 having a ring-like shape is formed to cover the outer terminals of the support members as well as the outer periphery of the fixed electrode 1105 except for its center portion in which the through holes 121 are formed. The in-process structure of FIG. 18F is completely soaked into an etching solution composed of hydrofluoric acid and is thus subjected to wet etching.

Due to the wet etching, the center portion of the first insulating layer 1132, which is brought into contact with the etching solution in the hollow 1111 of the semiconductor substrate 1102, is dissolved so that the diaphragm electrode 1107 is exposed, wherein the etching solution flows into the surrounding area of the circular plate 1114 of the diaphragm electrode 1107 so as to dissolve the second insulating layer 1136 on the circular plate 1114. In addition, the second insulating layer 1136 is brought into contact with the etching solution via the through holes 1121 of the fixed electrode 105 and the slits 1112 of the support members 1111 and is thus dissolved in connection with the through holes 1121 and the slits 1112. The dissolution of the insulating layers 1132 and 1136 does not progress in the thickness direction only; hence, plane etching or side etching also progress. By appropriately setting the etching time, it is possible to reliably remove the insulating substance from the prescribed areas between the fixed electrode 1105 and the diaphragm electrode 1107, thus forming the air gap 1106 between the electrodes 1105 and 1107. In addition, it is possible to form the interconnection poles 1113 for establishing interconnection between the insulating layer 1104 having the internal space 1113, the support members 1111, and the diaphragm electrode 1107.

In the aforementioned process, when a conductive layer 1133 serving as the diaphragm electrode 1107 is formed on the first insulating layer 1132, polysilicon whose thermal expansion coefficient is higher than that of silicon oxide used for the formation of the first insulating layer 1132 is provided at a high temperature. For this reason, when the conductive layer 1133 is completely embedded in the first insulating layer 1132 and the second insulating layer 1136 and is then reduced in temperature at room temperature, tensile stress occurs in the corresponding diaphragm electrode 1107. When the first insulating layer 1132 and the second insulating layer 1136 are dissolved so as to make the diaphragm electrode 1107 be placed in a hanging state as shown in FIG. 18F, the diaphragm electrode 1107 may be deformed and contracted inwardly in a radius direction due to the tensile stress.

Figure 19A:
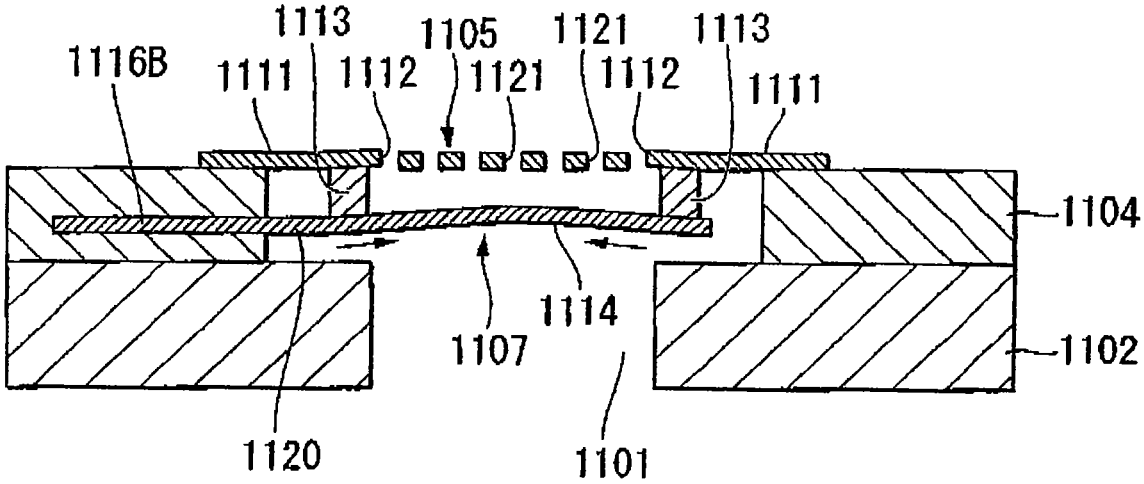
FIG. 19A is a cross-sectional view showing the deformation of the diaphragm electrode having three extension arms due to tensile stress.

The aforementioned phenomenon will be described in detail with reference to FIGS. 19A and 19B. As shown in FIG. 19A, as the circular plate 1114 of the diaphragm electrode 1107 is contracted inwardly in the radius direction, the lower ends of the interconnection poles 1113 connected with the supports 1111 are forced to move inwardly in the radius direction as shown by arrows, so that the interconnection poles 1113 are inclined and deformed, whereby the center portion of the circular plate 1114 is slightly lifted upwards.

The tip ends of the extension arms 1116A to 1116C extended from the circular plate 1114 are embedded in the insulating layer. In the aforementioned state, the extension arms 1116A to 1116C may act as horizontal resistance against the contraction of the circular plate 1114, wherein the horizontal resistance may be uniformly distributed because they are uniformly arranged in the circumferential direction of the circular plate 1014. Thus, the deformation of the circular plate 1114 becomes uniform, and the distance between the electrodes 1105 and 1117 also becomes uniform. In addition, the extension arms 1116A to 1116C horizontally pull the outer circumferential periphery of the circular plate 1114 although the circular plate 1114 is forced to be bent upwardly; hence, it is possible to suppress the excessive contraction of the circular plate 1114.

Figure 20:
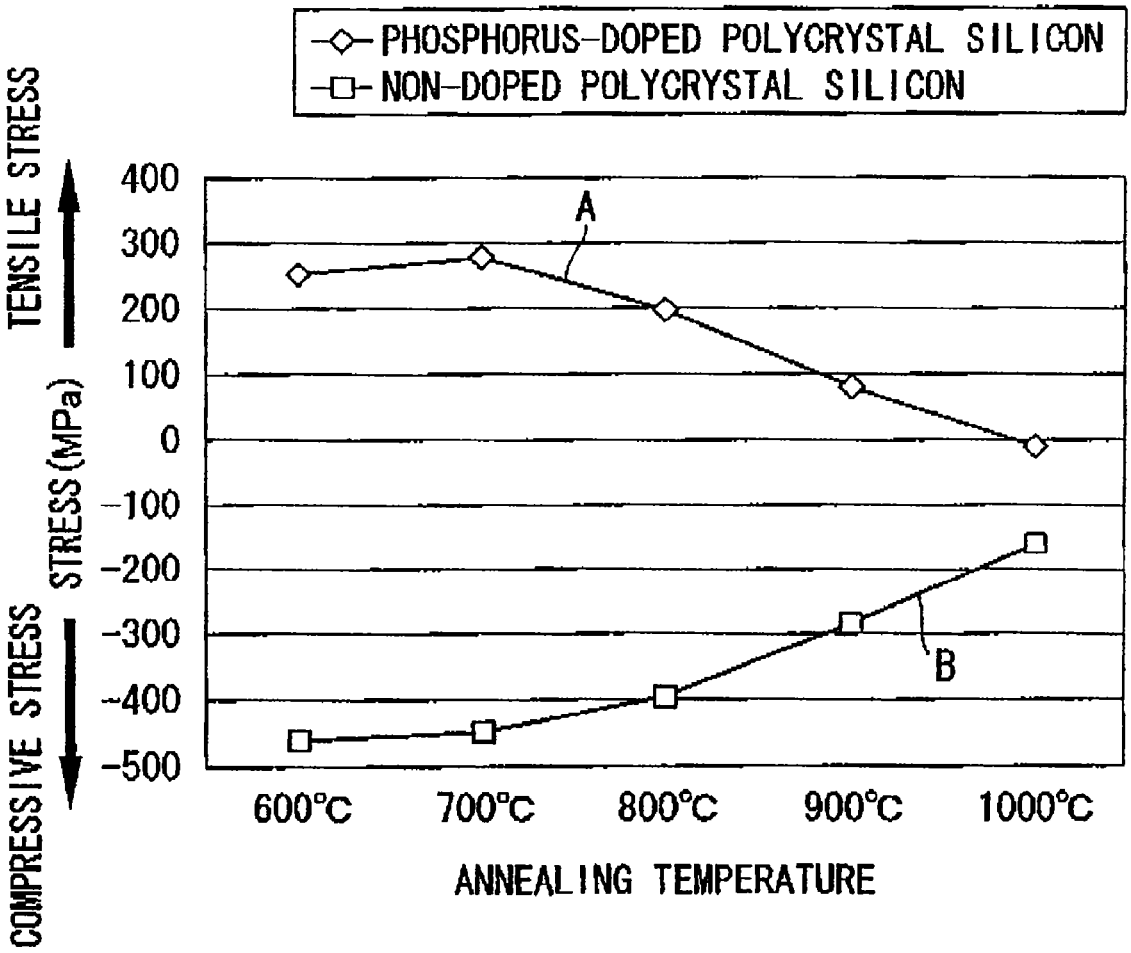
FIG. 20 is a graph showing the relationship between residual stress and annealing temperature in connection with phosphorus doping.

The present embodiment is designed such that the stress-adjusting portions 1120 are formed between the circular plate 1114 (from which the extension arms 1116A to 1116C are extended) and the prescribed portions fixed to the insulating layer 1104 so as to reduce the tensile stress in comparison with other portions. FIG. 20 shows how residual stress works after annealing upon comparison between the first case "A" in which impurities such as phosphorus (P) are doped into polycrystal silicon and the second case "B" in which no impurity is doped. It shows that tensile stress occurs in the impurities-doped case "A".

By adjusting the doping value and annealing temperature, it is possible to optimize the tensile stress applied to the stress adjusted portions 1120 of the extension arms 1116A to 1116C, whereby due to the tensile stress of the extension arms 1116A to 1116C, it is possible to maintain an appropriate distance between the electrode 1105 and 1107. In this case, it is possible to set the annealing temperature within a prescribed range below the glass transition point of the silicon oxide film. This increases pull-in voltage. As a result, it is possible to increase bias voltage; hence, it is possible to produce a microphone having a high sensitivity.

Figure 19B:
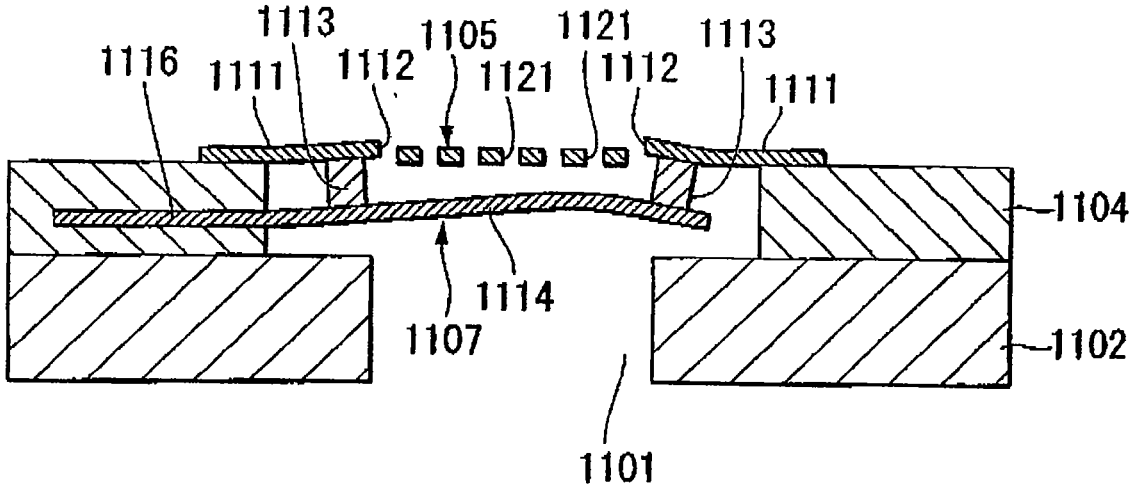
FIG. 19B is a cross-sectional view showing the deformation of the diaphragm electrode having a single extension arm due to tensile stress.

FIG. 19B shows another case in which only a single extension 1016 arm having a land 1107 is formed with respect to the diaphragm electrode 1107, wherein in the prescribed area in which the extension arm 1116 is arranged, even though the circular plate 1114 is contracted, it is horizontally pulled by the extension arm 1116; hence, the interconnection pole 1113 (positioned at the right side in FIG. 19B) close to the extension arm 1116 is prevented from being deformed and is not inclined so much in comparison with the other interconnection poles 1113. This produces asymmetrical deformation of the circular plate 1114; hence, the distance between the fixed electrode 1005 and the diaphragm electrode 1107 becomes non-uniform.

The present embodiment is characterized in that the three extension arms 1116A to 1116C are arranged in the outer periphery of the circular plate 1114 at equal distances (or equal angles) therebetween; hence, the circular plate 1114 is physically balanced and supported in three directions. This produces symmetrical deformation of the circular plate 1114 as shown in FIG. 19A; hence, the distance between the fixed electrode 1105 and the diaphragm electrode 1107 can be uniformly held. In addition, it is possible to reduce the distribution and magnitude of the tensile residual stress due to the uniform inclination and deformation of the interconnection poles 1013.

In the capacitor microphone 1101 of the present embodiment, when the circular plate 1114 of the diaphragm electrode 1107 vibrates in response to sound pressure transmitted via the through holes 1121 of the fixed electrode 1105, the distance between the fixed electrode 1105 and the circular plate 1114 of the diaphragm electrode 1107 varies, so that variations of the distance are detected as variations of the electrostatic capacitance between the electrodes 1105 and 1107. Herein, the circular plate 1114 of the diaphragm electrode 1107 is uniformly supported by means of the stress-adjusting portions 1107 of the extension arms 1116A to 1116C; hence, it is possible to maintain the uniform distribution of tensile stress, and it is possible to reduce resistance against vibration. Thus, the capacitor microphone 1101 of the present embodiment can respond to sound pressure at a high sensitivity.

Furthermore, the present embodiment secures the uniform deformation of the circular plate 1114 and also increases the response against vibration. This makes it possible to increase the pull-in voltage by appropriately setting the residual stress. As a result, it is possible to increase the bias voltage; hence, it is possible to produce the capacitor microphone having a high sensitivity.

In the present embodiment, all the extension arms 1116A to 1116C are formed in the same dimensions (or the same width) except the land 1117, and impurities are doped into the bridge portions formed between the circular plate 1114 and the prescribed portions fixed to the insulating layer 1004, thus forming the stress-adjusting portions 1120 by reducing the residual stress applied to the bridge portions. Instead, it is possible to form a plurality of through holes within the widths of the extension arms, or it is possible to partially reduce the widths of the extension arms, thus forming stress-adjusting portions by partially reducing the sectional areas of the extension arms. That is, it is preferable that the stress adjusted portions be formed to exert a prescribed range of tensile stress applied to the diaphragm electrode 1107 to such an extent in which the circular plate 1114 of the diaphragm electrode 1117 will not approach very close to the fixed electrode 1105.

The present embodiment is designed such that the extension arms 1116A to 1116C are positioned to suit the interconnection poles 1113, which support the circular plate 1114 in a hanging state. Instead, they can be positioned among the interconnection poles 1113. In addition, it is possible to arrange three or more supports 1111 and three or more interconnection poles 1113, which support the diaphragm electrode 1107 in a hanging state. Furthermore, it is possible to increase the number of the extension arms 1116 as necessary.

9. Eighth Embodiment

Figure 21:
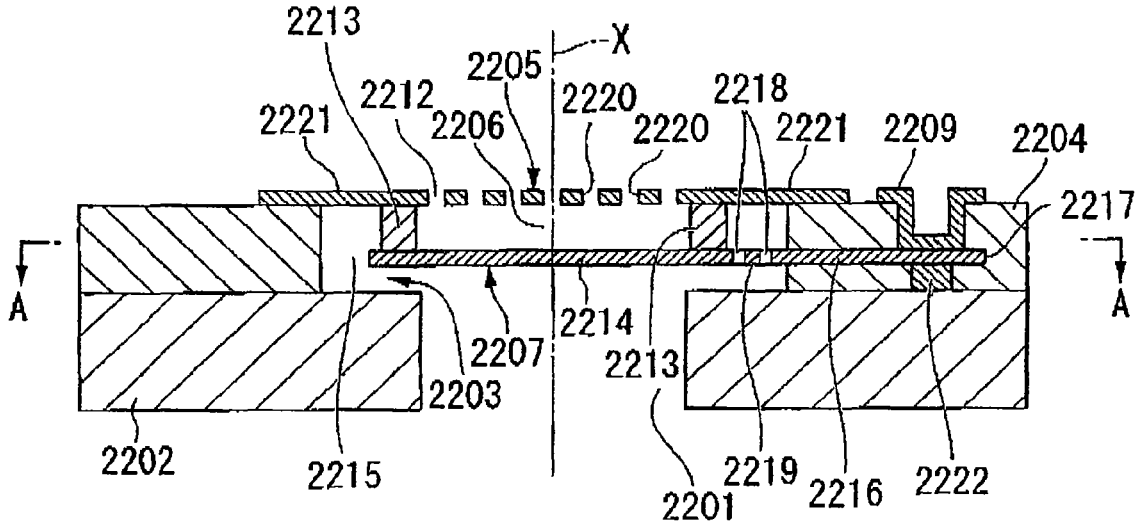
FIG. 21 is a cross-sectional view taken along line B-B in FIG. 22, which shows the constitution of a capacitor microphone in accordance with an eighth embodiment of the present invention.

FIG. 21 is a cross-sectional view showing the constitution of a capacitor microphone in accordance with an eighth embodiment of the present invention. That is, a capacitor microphone 2201 is formed using a block-like semiconductor substrate 2202 having a hollow 2201 at the center thereof. A ring-like insulating layer 2204 having an internal space 2203 whose size is larger than the size of the hollow 2201 is formed to surround the periphery of the hollow 2201. The outer periphery of a plate-like fixed electrode 2205 is fixed to the upper surface of the insulating layer 2204. A diaphragm electrode 207 is supported in parallel with the fixed electrode 2205 with an air gap 2006 therebetween.

Figure 22:
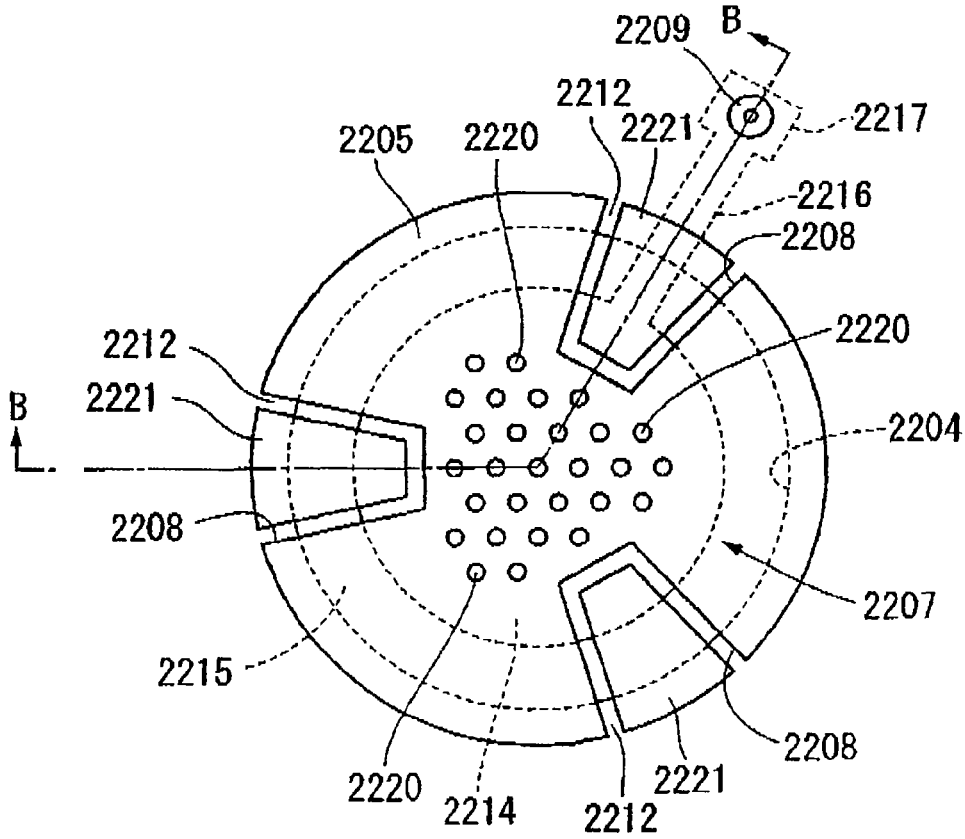
FIG. 22 is a plan view showing a fixed electrode having supports incorporated into the capacitor microphone shown in FIG. 21.

The overall shape of the fixed electrode 2205 is formed like a circular plate whose diameter is larger than the diameter of the internal space 2203 of the insulating layer 2204. As shown in FIG. 22, the outer periphery of the fixed electrode 2205 is partially cut out so as to form three recesses 2208, which are equally distanced from each other with an angle of 120° therebetween in the circumferential direction. In addition, tongue-like supports 2211 are arranged inside of the recesses 2208 of the fixed electrode 2205 with small gaps therebetween; hence, bent slits 2212 are formed between the supports 2211 and the interior walls of the recesses 2208 of the fixed electrode 2205. the outer periphery of the fixed electrode 2205 (except the supports 2211) and the outer terminals of the supports 2211 are fixedly attached to the insulating layer 2204; hence, the inner terminals of the supports 2211 project inwardly in a radius direction into the internal space 2203 from the insulating layer 2204.

Figure 23:
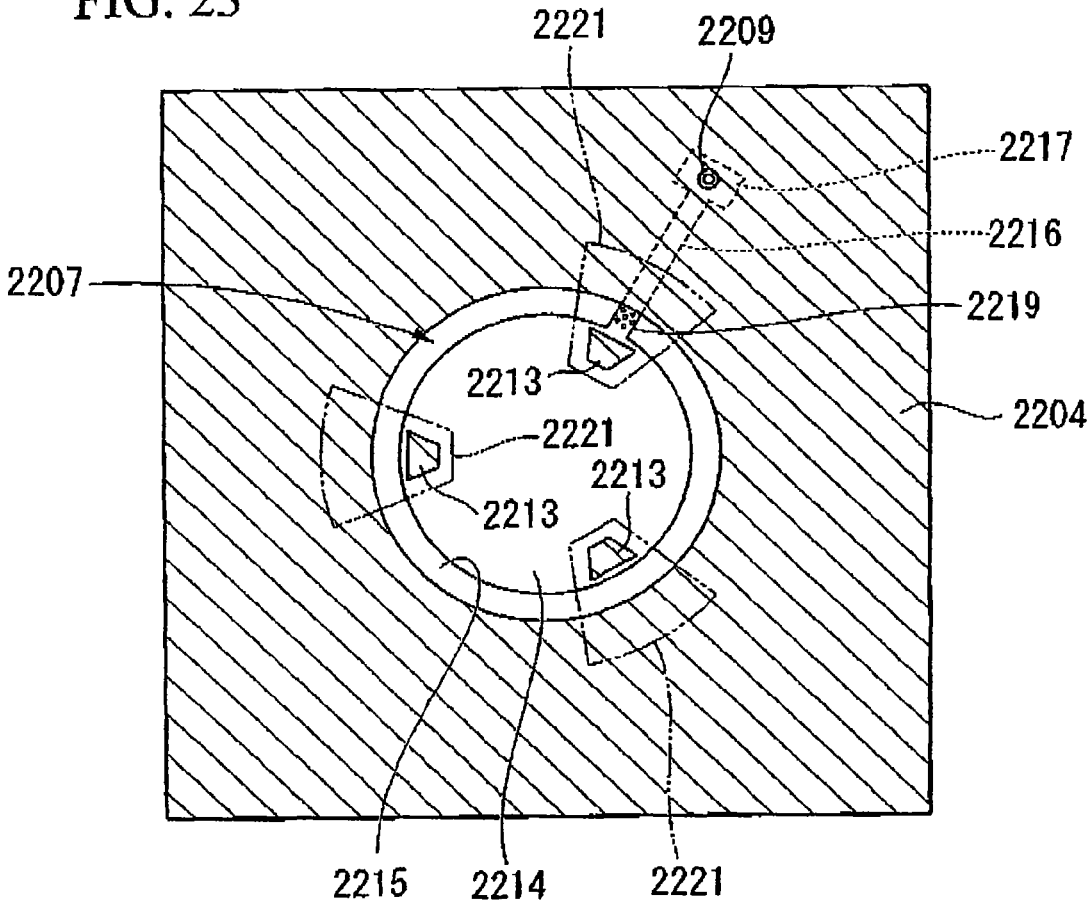
FIG. 23 is a plan view taken along line A-A in FIG. 21.

The inner terminals of the supports 2211 are interconnected to the outer periphery of the diaphragm electrode 2207 at three positions via interconnection poles 2213 composed of insulating substances. The diaphragm electrode 2207 as a whole is formed in a circular shape, which is realized by a circular plate 2214. The outer periphery of the circular plate 2214 is fixed to the supports 2211 at three positions via the interconnection poles 2213, so that the diaphragm electrode 2207 is supported in a hanging state in the hollow 2201 by way of the supports 2211. The circular plate 2214 of the diaphragm electrode 2207 is formed like a circular shape whose diameter is smaller than the diameter of the internal space of the insulating layer 2204. Hence, a ring space 2215 is formed between the outer periphery of the circular plate to 2214 and the interior circumferential walls of the insulating layer 2204. As shown in FIGS. 22 and 23, an extension terminal 2216 projecting outwardly in a radius direction is integrally formed together with the outer periphery of the circular plate 2214. The extension terminal 2216 traverses the ring space 2215 and is then embedded in the insulating layer 2204, wherein a land 2217 is formed at the tip end thereof.

Figure 24:
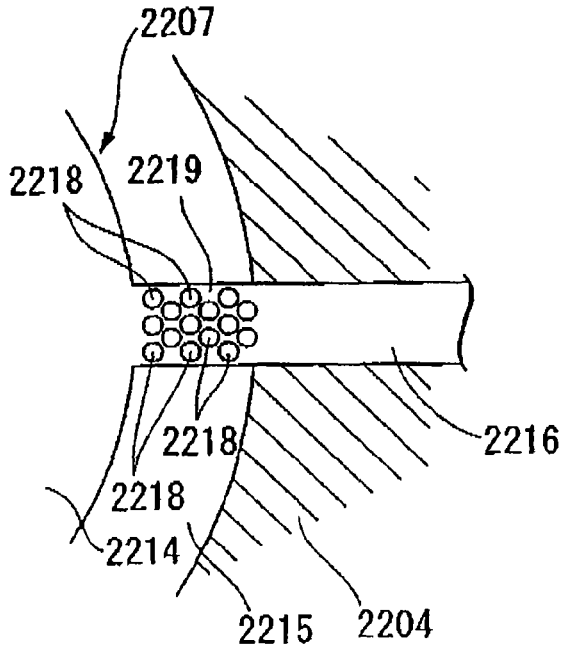
FIG. 24 is an enlarged view showing a prescribed part of an extension terminal having a stress absorbing portion.

The extension terminal 2216 is formed at a prescribed position substantially matching one interconnection pole 2213, wherein it is extended with the small width toward the land 2017. As shown in FIG. 24, a plurality of through holes 2218 are formed in a prescribed portion of the extension terminal 2216 traversing the ring space 2215. Due to the formation of the through holes 2218, the extension terminal 2216 is partially reduced in rigidity and is made deformable with ease. The through holes 2218 are formed in a zigzag manner. This makes it possible for the through holes 2218 to be extended while being deformed in surrounding areas thereof in response to tensile stress applied to the extension terminal 2216 in its length direction. That is, the zigzag formation of the through holes 2218 makes the prescribed portion of the extension terminal 2016 serve as a stress absorbing portion 2219.

Compared with the aligned formation of the through holes 2218, the zigzag formation of the through holes 2218 contributes to an improvement in terms of a stress absorbing effect. This will be explained below.

Suppose that eight through holes each having the same size (e.g., $\phi$10 μm in diameter) are formed in a plate of 0.66 μm thickness, 40 μm width, and 100 μm length. Herein, a first sample is produced by aligning four through holes in two lines respectively in the width direction of the plate so that eighth through holes are uniformly aligned in the plate in total; and a second sample is produced by alternately changing the number of through holes between two and one in the width direction of the plate so that eight through holes are formed in a zigzag manner in the plate in total. In order to compare the first and second samples in terms of the stress absorbing effect, one end of the plate is fixed, and reaction that is required to realize a displacement of 0.1 μm at the other end of the plate is measured. It is acknowledged that the second sample (corresponding to the present embodiment) is reduced in reaction to about 86% in comparison with the first sample.

Both of the fixed electrode 2205 and the diaphragm electrode 2207 are formed using conductive semiconductor films composed of polycrystal silicon (i.e., polysilicon). The diaphragm electrode 2207 is formed like a thin film that can easily vibrate in response to sound waves. A plurality of through holes 2220 allowing sound waves to transmit therethrough are uniformly distributed and form in the center area of the fixed electrode 2205 except the outer periphery. As shown in FIG. 21, both of the fixed electrode 2205 and the circular plate 2214 of the diaphragm electrode 2207 are disposed along the same axial line X.

The insulating layer 2204 is laminated in a ring-like shape in the outer periphery of the semiconductor substrate 2202 except for the surrounding area of the hollow 2201. Both of the insulating layer 2204 and the interconnection poles 2213 are composed of the same insulating substance such as silicon oxide.

An input terminal 2221 for establishing connection with an external device (not shown) is connected to the land 2217 formed at the tip end of the extension terminal 2216 of the diaphragm electrode 2207, wherein the upper surface thereof is exposed and wherein a conduction portion 222 for establishing connection between the land 2217 and the semiconductor substrate 2202 is formed in the backside of the land 2217. Incidentally, an output terminal (not shown) is attached to the fixed electrode 2205.

Next, the manufacturing method of the capacitor microphone 2201 will be described with reference to FIGS. 25A to 25E, which show the transition of the cross-sectional structures in manufacturing in relation to the extension terminal 2216 taken along line B-B in FIG. 22.

(a) Lamination Step

Figure 25A:
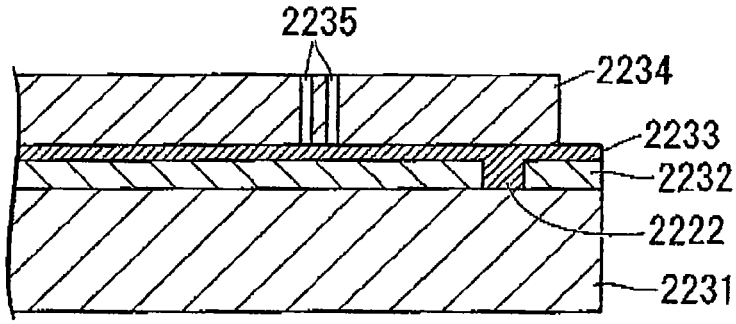
FIG. 25A is a cross-sectional view showing a first step for manufacturing the capacitor microphone in connection with a cross section taken along line B-B in FIG. 22.
Figure 25B:
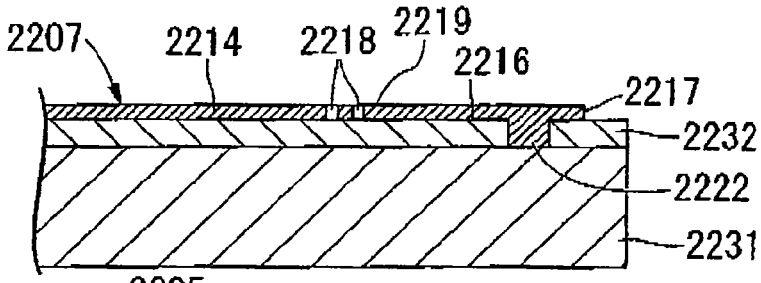
FIG. 25B is a cross-sectional view showing a second step for manufacturing the capacitor microphone.

As shown in FIG. 25A, insulating substances such as silicon oxide ($SiO_2$) are deposited on the surface of a plate substrate 2231 composed of monocrystal silicon serving as the semiconductor substrate 2202 by way of the thin-film forming technique such as CVD (Chemical Vapor Deposition), thus forming a first insulating layer 2232.

A conductive layer 2233 composed of polysilicon serving as the diaphragm electrode 2207 is formed on the first insulating layer 2232.

A through hole is formed in advance at a position matching the land 2217 of the extension terminal 2216 of the diaphragm electrode 2207, wherein the conductive layer 2233 is formed to fill the through hole, thus integrally forming a conduction portion 2222 for establishing connection between the conductive layer 2233 and the plate substrate 2231.

A resist is applied onto the conductive layer 2233 and is then subjected to exposure and development processing, thus forming a resist layer 2234 covering a prescribed area serving as the diaphragm electrode 2207. A plurality of holes are formed in the area serving as the stress absorbing portion 2219 of the extension terminal 2216 in the resist layer 2234. Then, RIE (Reactive Ion Etching) is performed so as to form the diaphragm electrode 2207 in which a plurality of through holes 2218 are formed in the stress absorbing portion 2219. Thereafter, the resist layer 2234 is removed using a resist peeling solution, thus producing an in-process structure shown in FIG. 25B.

Next, an insulating substance composed of silicon oxide is deposited to entirely cover the diaphragm electrode 2207 by way of CVD, thus forming a second insulating layer 2236.

In addition, a conductive layer composed of polysilicon is formed on the second insulating layer 2236 by way of CVD, thus forming a resist layer covering prescribed areas matching the fixed electrode 2005 and the supports 2211 on the conductive layer. It is subjected to etching such as RIE so as to form the fixed electrodes 2205 having through holes 2220 and the supports 2211. After completion of the formation of the fixed electrode 205 and the supports 2211, the resist layer is removed, thus producing an in-process structure shown in FIG. 25C. Herein, the fixed electrode 2205 is reliably separated from the supports 2211 via the bent slits 2212.

Above the land 2217 of the diaphragm electrode 2217, a through hole is formed in the second insulating layer 2236; then, an input terminal 2221 for establishing connection with an external device (not shown) is formed by performing aluminum plating on the through hole.

(b) Hollow Forming Step

Figure 25C:
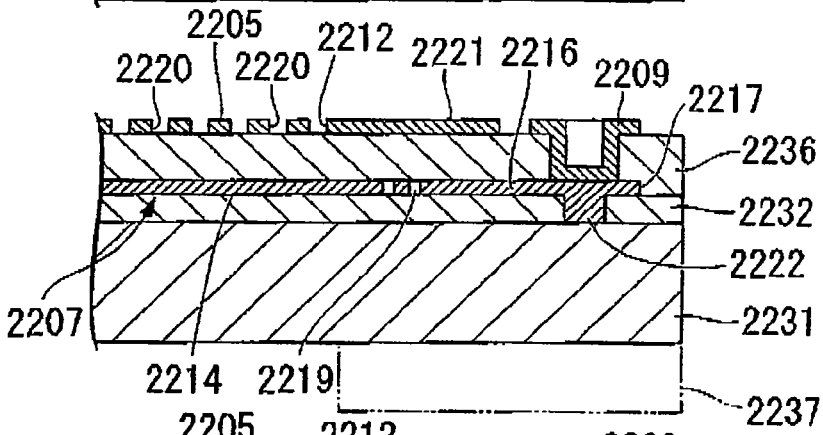
FIG. 25C is a cross-sectional view showing a third step for manufacturing the capacitor microphone.
Figure 25D:
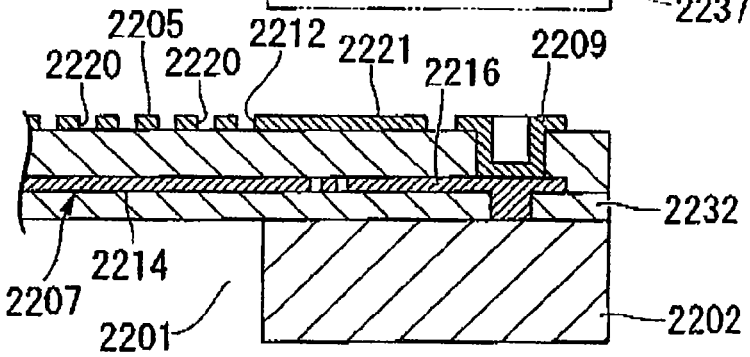
FIG. 25D is a cross-sectional view showing a fourth step for manufacturing the capacitor microphone.

Next, as shown in FIG. 25C (see dashed lines), a resist layer 2237 is formed to cover the backside of the plate substrate 2231 except for the center portion serving as the hollow 2201. Then, deep RIE is performed to remove the center portion of the plate substrate 2231 in such a way that etching progresses to reach the interface between the plate substrate 2231 and the first insulating layer 2232, thus forming the semiconductor substrate 2202 having the hollow 2201 as shown in FIG. 25D. After completion of the formation of the hollow 2201, the resist layer 2237 is removed from the semiconductor substrate 2202.

(c) Wet Etching Step

Figure 25E:
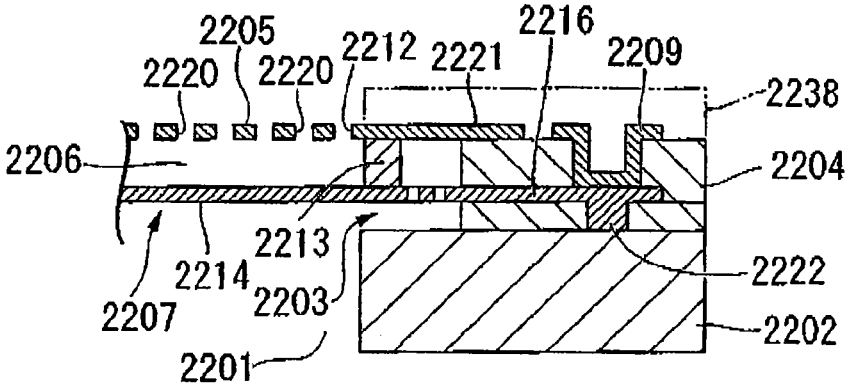
FIG. 25E is a cross-sectional view showing a fifth step for manufacturing the capacitor microphone.

Next, as shown in FIG. 25E, a ring resist layer 2238 is formed to cover the outer periphery of the fixed electrode 2205 and the outer terminals of the supports 2211 except for the center portion in which the through holes 2220 of the fixed electrode 2205 are formed. The in-process structure of FIG. 25E is soaked into an etching solution such as hydrofluoric acid and is thus subjected to wet etching.

Due to the wet etching, the center portion of the first insulating layer, which is brought into contact with the etching solution in the hollow 2201 of the semiconductor substrate 2202, is dissolved so as to expose the diaphragm electrode 2207. The etching solution flows into the surrounding area of the circular plate 2214 of the diaphragm electrode 2207 so as to dissolve the second insulating layer 2236 on the circular plate 2014. In addition, the prescribed portions of the second insulating layer 2236, which are brought into contact with the etching solution via the through holes 2220 of the fixed electrode 2205 and the slits 2212 formed between the fixed electrode 2205 and the supports 2211, are dissolved in relation to the through holes 2220 and the slits 2212. The dissolution does not progress only in the thickness direction with respect to the insulating layers 2232 and 2236 but in a horizontal direction (or a plane direction) by way of side etching. By appropriately setting the etching time, the insulating layer(s) between the fixed electrode 2205 and the diaphragm electrode 2207 is removed so as to form an air gap 2206 between the electrodes 2205 and 2207. In addition, the interconnection poles 2213 are formed to interconnect together the insulating layer 2204 having the internal space 2203, the supports 2211, and the diaphragm electrode 2207.

In a series of steps of the aforementioned manufacturing process, when the conductive layer 2233 serving as the diaphragm electrode 207 is formed on the first insulating layer 2232, there is provided polysilicon whose thermal expansion coefficient is higher than that of silicon oxide forming the first insulating layer 2232 at a high temperature. For this reason, when the diaphragm electrode 2207 (i.e., conductive layer 2233) is embedded in the first insulating layer 2232 and the second insulating layer 2236 and is reduced in temperature at room temperature, it bears tensile stress. When the insulating layers 2232 and 2236 are dissolved so that the diaphragm electrode 2207 is placed in a hanging state as shown in FIG. 5E, the diaphragm electrode 2007 is forced to be deformed and contracted inwardly in a radius direction due to the tensile stress applied thereto.

The aforementioned phenomenon will be described with reference to FIG. 26A, in which since the circular plate 2214 of the diaphragm electrode 2207 is contracted inwardly in a radius direction, the lower ends of the interconnection poles 2213 whose upper ends are connected to the supports are forced to be moved inwardly in directions designated by arrows, so that the interconnection poles 2213 are inclined and deformed; hence, the center portion of the circular plate 2214 is slightly lifted upwards and is supported thereat. The stress absorbing portion 2219 is formed at the prescribed position between the circular plate 2214 and the insulating layer 2204 with respect to the extensions terminal 2216, which extends from the circular plate 2214, and is extendable and deformable so as to absorb tensile stress; hence, it is possible not to disturb the free inclination and deformation of the interconnection poles 2213.

Figure 26A:
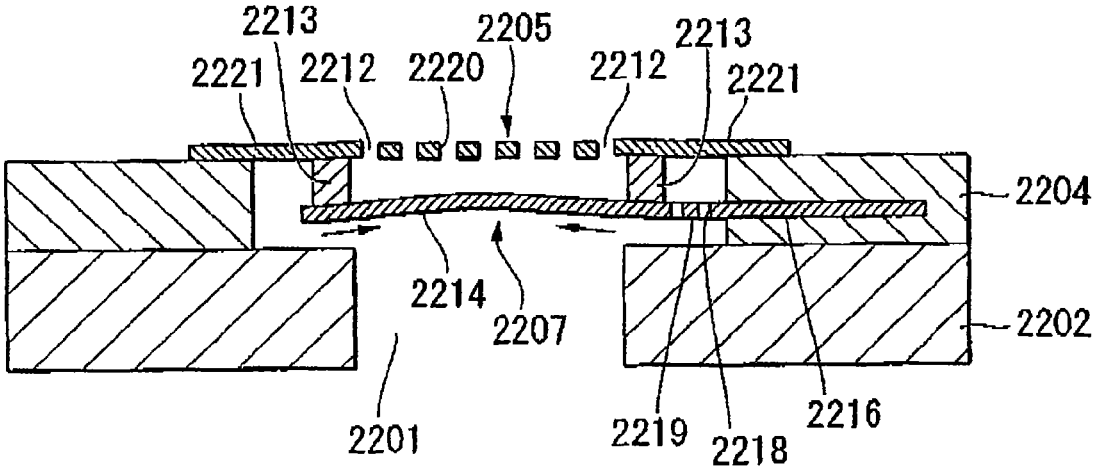
FIG. 26A is a cross-sectional view showing the deformation of a circular plate of a diaphragm electrode due to tensile stress by way of an extension terminal having a stress absorbing portion.
Figure 26B:
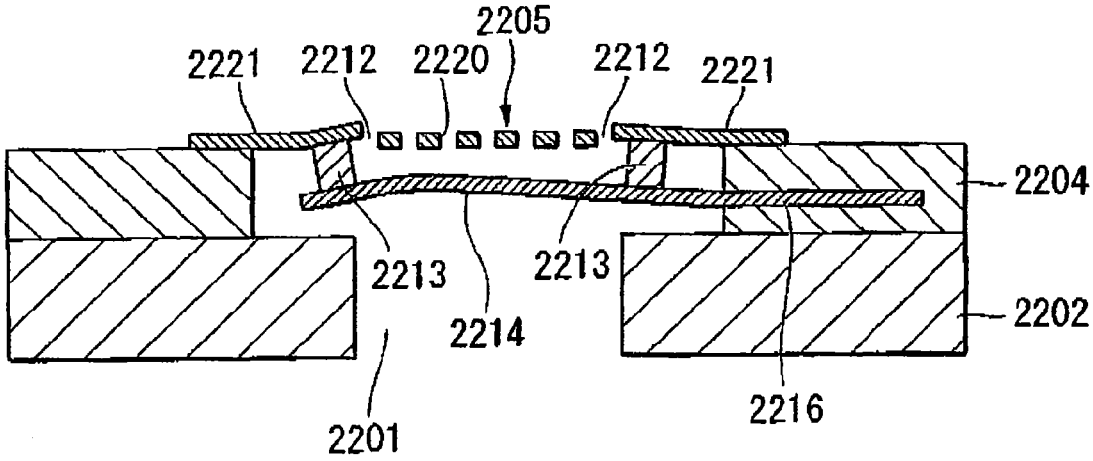
FIG. 26B is a cross-sectional view showing the deformation of a circular plate of a diaphragm electrode due to tensile stress by way of an extension terminal not having a stress absorbing portion.

In the case of FIG. 26B in which the extension terminal 2216 does not have the stress absorbing portion 2219, the circular plate 2214 is partially pulled by the extension terminal 2216 even when the circular plate 2214 is contacted. This reduces the deformation and inclination of the interconnection pole 2213 (i.e., the right-side interconnection pole 2213 in FIG. 26B), which is positioned close to the extension terminal 2216, in comparison with the other interconnection pole 2213 (i.e., the left-side interconnection pole 2213 in FIG. 26B); therefore, the circular plate 2214 is subjected to asymmetric deformation so that the gap between the circular plate 2214 and the fixed electrode 2215 becomes uneven.

In contrast, the capacitor microphone 2201 of the present embodiment is characterized in that the extension terminal 2216 has the stress absorbing portion 2219, which realizes symmetric deformation with respect to the circular plate 2214 as shown in FIG. 26A; hence, it is possible to uniformly hold the gap between the circular plate 2214 and the fixed electrode 2205. In addition, residual tensile stress is distributed in the circular plate 2214 in a relatively small area and is reduced in magnitude due to the uniform inclination and deformation of the interconnection poles 2213.

In the capacitor microphone 2201 having the aforementioned constitution, when the circular plate 2214 of the diaphragm electrode 2207 vibrates in response to sound pressure transmitted thereto via the through holes 2220 of the fixed electrode 2205, the distance between the fixed electrode 2205 and the circular plate 2214 of the diaphragm electrode 2207 varies so as to cause variations of electrostatic capacitance between these electrodes 2205 and 2207, which are then detected. The present invention is designed to reduce residual tensile stress applied to the circular plate 2214 of the diaphragm electrode 2207 by way of the stress-absorbing portion 2219; thus, it is possible to realize a high sensitivity in response to sound pressure without disturbing the vibration of the circular plate 2214.

As described above, the capacitor microphone 2201 realizes the uniform deformation of the circular plate 2214 and also increases the response against the vibration. By appropriately setting residual stress, it is possible to increase the pull-in voltage, which in turn increases the bias voltage so as to realize a high sensitivity.

In the present embodiment, the extension terminal 2216 is formed with the same width except for the land 2017, wherein a plurality of through holes 218 are formed within the width so as to form the stress-absorbing portion 2219. Several variations or modifications can be adapted to the stress-absorbing portion 2219 of the extension terminal 2216 as shown in FIGS. 27 to 32, wherein parts identical to those shown in FIGS. 21 to 23 are designated by the same reference numerals; hence, shape differences will be described below.

Figure 27:
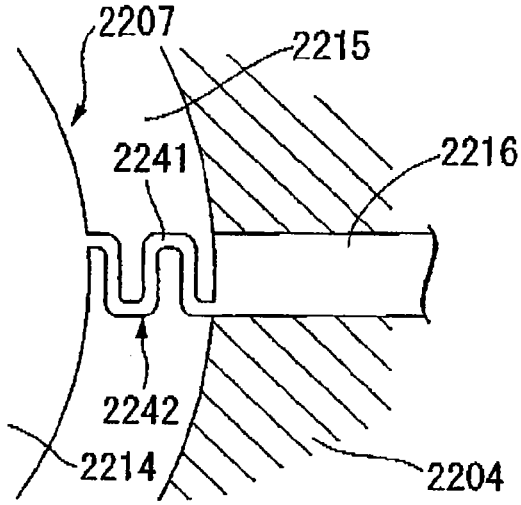
FIG. 27 shows a first variation of the stress absorbing portion formed in the extension terminal.

FIG. 27 shows a first variation in which the prescribed portion of the extension terminal 2016 facing the ring space 2215 is reduced in thickness in comparison with the other portions so as to form a thin portion 2241, which is bent in a meandering shape within the horizontal plane of the extension terminal 2216 so as to form a stress absorbing portion 2242.

Since the stress-absorbing portion 2242 is formed by bending the thin portion 2241 in the ring space 2215, the overall size and length thereof are increased to be larger than dimensions of the ring space 2215 in its radius direction. That is, the thin portion 2241 is stretched so as to absorb tensile stress occurring in the manufacturing process or is stretched when the circular plate 2214 vibrates in response to sound pressure.

Figure 28:
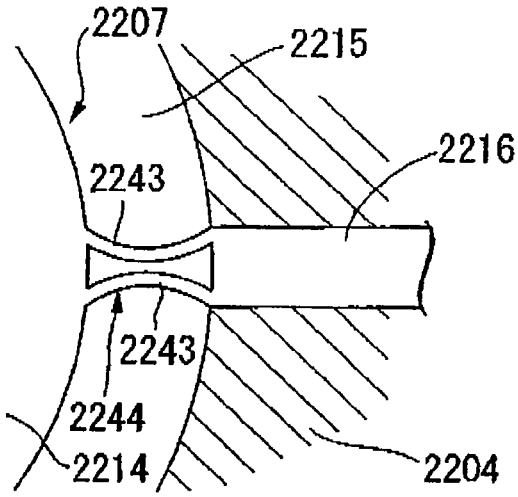
FIG. 28 shows a second variation of the stress absorbing portion formed in the extension terminal.

FIG. 28 shows a second variation in which the prescribed portion of the extension terminal 2216 facing the ring space 2215 is formed using paired thin portions 2243, which are bent in a catenary shape so as to form a stress absorbing portion 2244.

Since the stress-absorbing portion 2244 is formed by bending the thin portions 2243 in the ring space 2215, the overall size and length thereof are increased to be larger than dimensions of the ring space 2215 in its radius direction. That is, the thin portions 2243 are stretched so as to absorb tensile stress occurring in the manufacturing process or are stretched when the circular plate 2214 vibrates in response to sound pressure.

Figure 29:
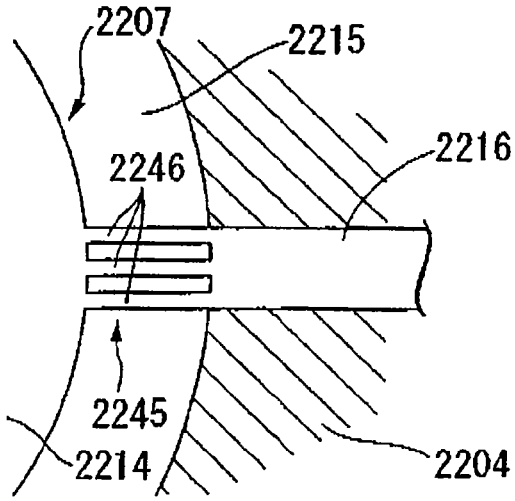
FIG. 29 shows a third variation of the stress absorbing portion formed in the extension terminal.

FIG. 29 shows a third variation in which a stress-absorbing portion 2245 is realized by three thin portions 2246, which are arranged in parallel within the width of the extension portion 2216.

Figure 30:
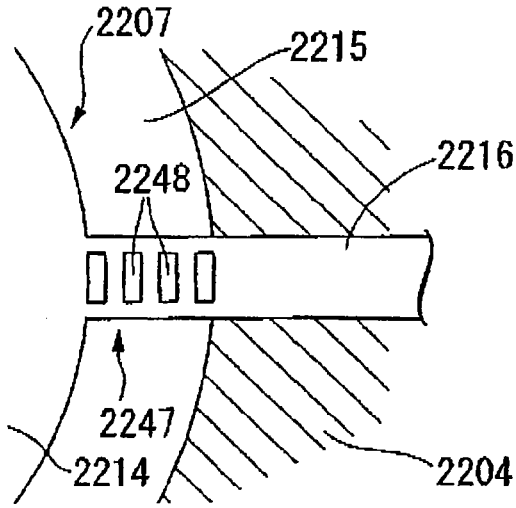
FIG. 30 shows a fourth variation of the stress absorbing portion formed in the extension terminal.

FIG. 30 shows a fourth variation in which a stress-absorbing portion 2247 is realized by a plurality of rectangular through holes 2248, which are arranged in a ladder-like formation within the width of the extension terminal 2216.

Figure 31:
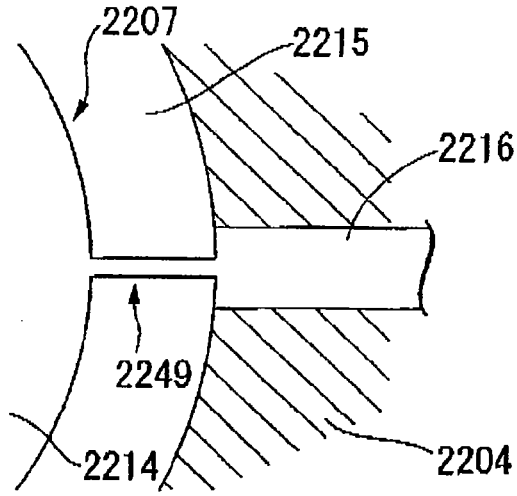
FIG. 31 shows a fifth variation of the stress absorbing portion formed in the extension terminal.

FIG. 31 shows a fifth variation in which a stress-absorbing portion 2249 is realized by a single linear thin portion whose width is reduced in comparison with the other portions of the extension terminal 2216.

Figure 32:
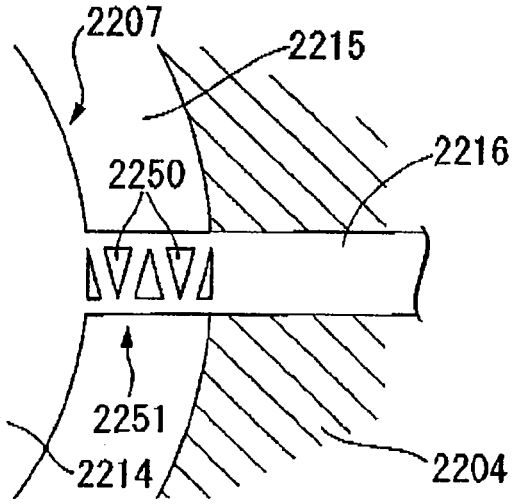
FIG. 32 shows a sixth variation of the stress absorbing portion formed in the extension terminal.

FIG. 32 shows a sixth variation in which a stress-absorbing portion 2251 is realized by forming a plurality of triangular through holes 2250, which are arranged by alternately changing directions thereof with 180° within the width of the extension terminal 2216.

All of the aforementioned variations of the stress-absorbing portions can be easily stretched and deformed. In addition, when the stress absorbing portion is realized using the thin portion that is bent or curved in a meandering shape, it is not necessarily bent or curved in the horizontal plane but can be waved in the thickness direction (or vertical direction). When the stress absorbing portion is realized by forming a plurality of through holes, it is possible to employ a variety of shapes such as circular shapes, triangular shapes, rectangular shapes, and hexagonal shapes with respect to the through holes. Herein, it is preferable that through holes be arranged in a zigzag manner. Since the diaphragm electrode 2207 is supported in a hanging state by means of the supports 2211, it is necessary for the extension terminal 2216 to establish electric connection with the circular plate 2214 of the diaphragm electrode 2207. In other words, it is not necessary for the extension terminal 2216 to have a relatively large rigidity allowing the circular plate 2214 to be supported.

Figure 33:
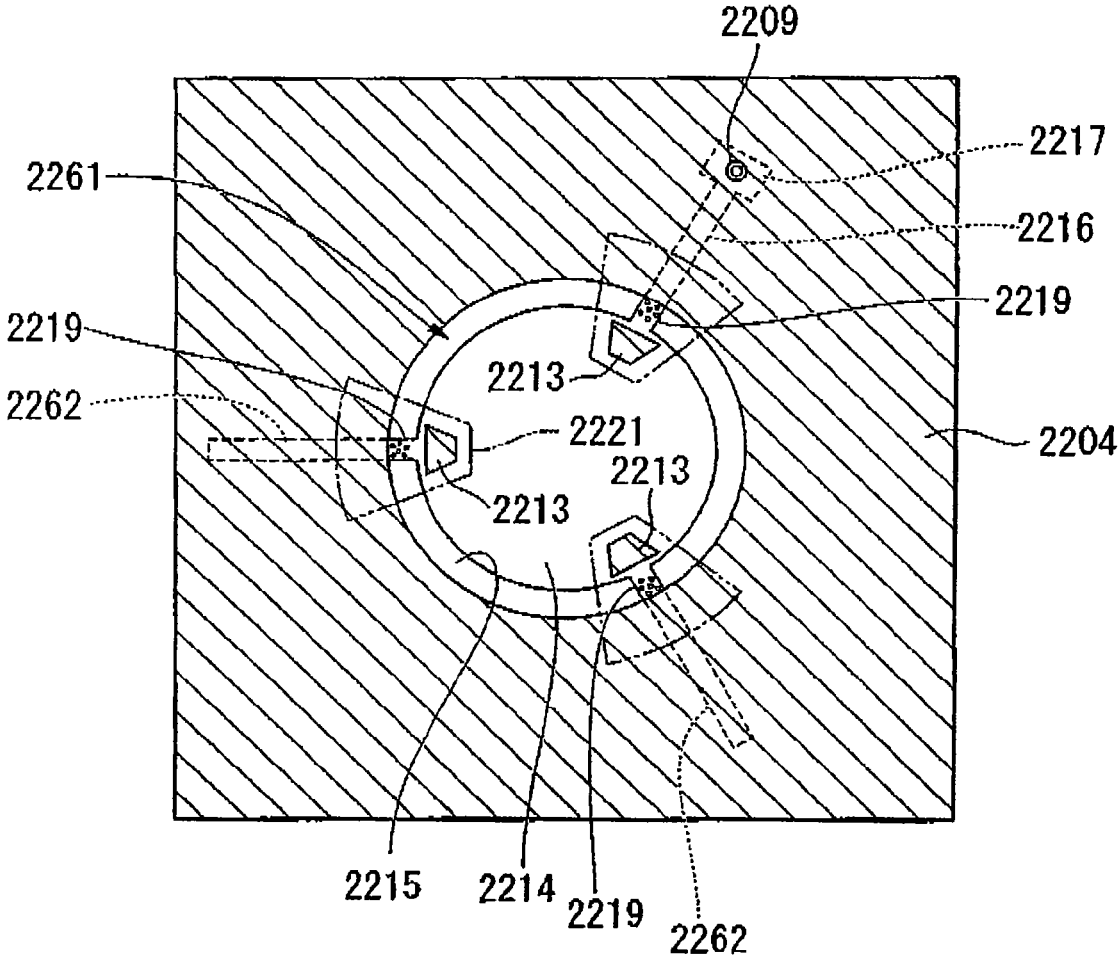
FIG. 33 is a cross-sectional view showing a variation of the capacitor microphone of the eighth embodiment shown in FIG. 23.

FIG. 33 shows a variation of the eighth embodiment, in which a diaphragm electrode 2261 has two extension arms 2262, which are independently formed in the outer periphery of the circular plate 2014, in addition to the extension terminal 2216 having the land 2217. Each of the extension arms 2262 (not having the land 2217) is shaped to match the width of the extension terminal 2216, and two stress-absorbing portions each corresponding to the stress-absorbing portion 2219 of the extension terminal 2216 are formed at the prescribed portions of the extension arms 2262 facing the ring space 2215. Similar to the extension terminal 2216, the extension arms 2262 are positioned to match the interconnection poles 2213, whereby the extension arms 2262 and the extension terminal 2216 are arranged with equal spacing (i.e., an angle of 120°) therebetween in the outer periphery of the circular plate 2214. The stress-absorbing portions 2219 are not necessarily realized by forming a plurality of through holes 2218; hence, it is possible to employ the aforementioned variations shown in FIGS. 27 to 32.

In the aforementioned capacitor microphone, the circular plate 2214 of the diaphragm electrode 2261 is supported at three positions in the same plane, wherein the stress absorbing portions 2219 are appropriately deformed so as to absorb tensile stress, which occurs in the manufacturing process, and are appropriately deformed when the circular plate 2214 vibrates in response to sound pressure. Since the extension terminal 2216 and the extension arms 2262 are uniformly positioned with the equal spacing therebetween in the circumferential direction of the circular plate 2214, the circular plate 2214 is uniformly supported and is thus balanced in three directions in terms of the mass thereof; hence, it is possible to maintain uniform stress distribution with respect to the circular plate 2214.

In the above, the extension terminal 2216 and the extension arms 2262 are not necessarily positioned to match the interconnection poles 2213 for supporting the circular plate 2214 in a hanging state but can be positioned between the interconnection poles 2213. It is not necessary to set three sets of the supports 2211 and the interconnection poles 2213, which support the diaphragm electrode 2207 in a hanging state; hence, it is possible to increase the number of the extension arms 2262.

As described heretofore, the present invention can be further modified within the scope of the invention defined by the appended claims; hence, all embodiments and variations are illustrative and not restrictive.

INDUSTRIAL APPLICABILITY

The present invention is applicable to capacitor microphones having simple structures, which can be manufactured using semiconductor substrates, for use in home appliances, audio/visual devices, communication devices, information terminals, and the like.

The invention claimed is:

1. A capacitor microphone comprising:

a plate having a fixed electrode;

a diaphragm including a center portion and at least one near-end portion that is formed at an outer periphery of the diaphragm, wherein the center portion has a vibrating electrode, wherein the vibrating electrode is positioned relative to the fixed electrode, wherein the center portion is increased in rigidity in comparison with the near-end portion, and wherein the center portion and the near-end portion are made from the same material; and a spacer that is fixed to the plate and the near-end portion of the diaphragm to form an air gap between the plate and the diaphragm; and a plurality of extension arms that project outwardly from the outer periphery of the diaphragm and that are arranged with equal spacing therebetween in a circumferential direction of the diaphragm, wherein a tip end of one extension arm is connected with an external connection terminal.

2. The capacitor microphone according to claim 1, wherein the center portion of the diaphragm is increased in thickness in comparison with the near-end portion.

3. The capacitor microphone according to claim 1, wherein the rigidity of the diaphragm is gradually increased in a direction from the outer periphery to the center portion.

4. The capacitor microphone according to claim 3, wherein the diaphragm is formed using a thin portion and a thick portion whose density is gradually increased in a direction from the outer periphery to the center portion.

5. The capacitor microphone according to claim 4, wherein the thin portion is formed using a first film, and the thick portion is formed using the first film and a second film which is decreased in density in comparison with the first film.

6. A capacitor microphone in which a diaphragm electrode is distanced and supported in parallel with a fixed electrode, which is bridged over an internal space of an insulating layer formed in a surrounding area of a hollow of a semiconductor substrate, so that variations of electrostatic capacitance formed between the fixed electrode and the diaphragm electrode are detected in response to variations of sound pressure applied to the diaphragm electrode, said capacitor microphone comprising:

a circular plate incorporated into the diaphragm electrode, wherein the circular plate is supported by inner ends of supports extended inwardly from the insulating layer in a hanging state in parallel with the fixed electrode; and a plurality of extension arms that project outwardly from an outer periphery of the circular plate and that are arranged with equal spacing therebetween in a circumferential direction of the circular plate, wherein tip ends of the extension arms are fixed to the insulating layer, and wherein the tip end of one extension arm is connected with an external connection terminal, which is exposed from the insulating layer.

7. The capacitor microphone according to claim 6, wherein each of the extension arms has a stress-adjusting portion for adjusting tensile stress exerted on the circular plate outwardly in a radius direction.

8. A capacitor microphone in which a fixed electrode is bridged over an internal space of an insulating layer formed to surround an outer periphery of a hollow of a semiconductor substrate, and a diaphragm electrode is supported in parallel with the fixed electrode with a prescribed distance therebetween, so that variations of electrostatic capacitance between the fixed electrode and the diaphragm electrode are detected in response to variations of pressure applied to the diaphragm electrode, wherein the diaphragm electrode has a circular plate that is supported in a hanging state in parallel with the fixed electrode by way of inner terminals of supports inwardly extending from the insulating layer, one end of an extension terminal is fixed to a prescribed portion of the insulating layer in an outer periphery of the circular plate, and another end of the extension terminal is outwardly exposed from the insulating layer, and wherein a stress-absorbing portion that is easily deformable in comparison with the circular plate is formed at a prescribed position of the extension terminal between the circular plate and the prescribed portion of the insulating layer.

9. The capacitor microphone according to claim 8 further comprising a plurality of extension arms that are extended outwardly in a radius direction in the outer periphery of the circular plate and are positioned with a prescribed spacing therebetween in a circumferential direction, wherein each of the extension arms has a prescribed portion fixed to the insulating layer so that a stress-absorbing portion, which is deformable with ease in comparison with the circular plate, is formed between the circular plate and the prescribed portion of the insulating layer.

10. The capacitor microphone according to claim 9, wherein the extension terminal and the extension arms are positioned with equal spacing therebetween in the outer periphery of the circular plate of the diaphragm electrode.

11. The capacitor microphone according to claim 8, wherein the stress-absorbing portion is formed in a bent shape or a curved shape so that an overall length thereof is larger than a distance between the circular plate and the insulating layer in the radius direction.

12. The capacitor microphone according to claim 8, wherein a plurality of through holes are formed in the stress-absorbing portion.

13. The capacitor microphone according to claim 9, wherein the stress-absorbing portion is formed in a bent shape or a curved shape so that an overall length thereof is larger than a distance between the circular plate and the insulating layer in the radius direction.

14. The capacitor microphone according to claim 10, wherein the stress-absorbing portion is formed in a bent shape or a curved shape so that an overall length thereof is larger than a distance between the circular plate and the insulating layer in the radius direction.

15. The capacitor microphone according to claim 9, wherein a plurality of through holes are formed in the stress-absorbing portion.

16. The capacitor microphone according to of claim 10, wherein a plurality of through holes are formed in the stress-absorbing portion.

* * * * *